US008674924B2

(12) United States Patent
Nose

(10) Patent No.: US 8,674,924 B2
(45) Date of Patent: Mar. 18, 2014

(54) DISPLAY DEVICE COMPRISING NORMAL/MULTIPLIED SPEED DRIVE SWITCHING CIRCUIT AND DATA DRIVER AND OPERATING METHOD THEREOF

(75) Inventor: Takashi Nose, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 426 days.

(21) Appl. No.: 12/847,653

(22) Filed: Jul. 30, 2010

(65) Prior Publication Data

US 2011/0032235 A1 Feb. 10, 2011

(30) Foreign Application Priority Data

Aug. 10, 2009 (JP) ..... 2009-186136

(51) Int. Cl.
*G09G 3/36* (2006.01)
*G09G 5/00* (2006.01)

(52) U.S. Cl.
USPC ..... 345/100; 345/204

(58) Field of Classification Search
CPC ..... G09G 3/3688
USPC ..... 345/98, 100, 204
See application file for complete search history.

(56) References Cited

U.S. PATENT DOCUMENTS

| | | | | |
|---|---|---|---|---|
| 7,084,850 | B2 * | 8/2006 | Hiyama et al. | 345/98 |
| 7,095,398 | B2 * | 8/2006 | Fish | 345/98 |
| 7,280,103 | B2 | 10/2007 | Taoka et al. | |
| 7,629,956 | B2 * | 12/2009 | Jang et al. | 345/100 |
| 2002/0118183 | A1 | 8/2002 | Inuzuka et al. | |
| 2003/0076288 | A1 * | 4/2003 | Fish | 345/98 |
| 2006/0017684 | A1 * | 1/2006 | Fish | 345/100 |
| 2006/0028422 | A1 * | 2/2006 | Jung | 345/100 |
| 2006/0284816 | A1 * | 12/2006 | Jang et al. | 345/98 |
| 2007/0002059 | A1 * | 1/2007 | Booth et al. | 345/505 |
| 2007/0120862 | A1 * | 5/2007 | Kosuga | 345/555 |
| 2013/0286000 | A1 | 10/2013 | Han et al. | |

FOREIGN PATENT DOCUMENTS

| | | | |
|---|---|---|---|
| CN | 101123734 | A | 2/2008 |
| JP | 2002-215111 | A | 7/2002 |
| JP | 2002-229547 | A | 8/2002 |
| JP | 2002-262243 | A | 9/2002 |

(Continued)

OTHER PUBLICATIONS

N. Kimura et al., New Technologies for Large-Sized High-Quality LCD TV, SID 05 Digest, 2005, pp. 1737-1737.

(Continued)

*Primary Examiner* — Adam J Snyder
(74) *Attorney, Agent, or Firm* — Foley & Lardner LLP

(57) ABSTRACT

A display device is provided with: a display panel; a driver driving the display panel; and a controller adapted to perform multiplied-speed drive processing on original image data externally supplied thereto. The driver is adapted to drive the display panel by multiplied speed driving. When the driver performs the multiplied-speed driving, the controller generates multiplied-speed drive image data by performing the multiplied-speed drive processing on the original image data, generates compressed image data by compressing the multiplied-speed drive image data, and transfers the compressed image data to the driver. In this case, the driver decompresses the compressed image data to thereby reproduce the multiplied-speed drive image data, and drives the display panel in response to the reproduced multiplied-speed drive image data. When the driver does not perform the multiplied-speed driving, on the other hand, the controller transfers the original image data to the driver, and the driver drives the display panel in response to the original image data received from the controller.

12 Claims, 15 Drawing Sheets

(56) References Cited

FOREIGN PATENT DOCUMENTS

| | | | |
|---|---|---|---|
| JP | 2003-78856 | A | 3/2003 |
| JP | 2003-134342 | A | 5/2003 |
| JP | 2005-05803 | A | 2/2005 |
| JP | 2005-55825 | A | 3/2005 |
| JP | 4079793 | B2 | 2/2008 |
| JP | 2008-165161 | A | 7/2008 |

OTHER PUBLICATIONS

K. Ono et al., Progress of IPS-Pro Technology for LCD-TVs, SID 06 Digest, 2006, pp. 1954-1957.

Taesun Kim et al., Impulsive Driving Technique in S-PVA Architecture, SID 06 Digest, 2006, pp. 1708-1711.

Sang Soo Kim et al., Distinguished Paper: Novel TFT-LCD Technology for Motion Blur Reduction Using 120 Hz Driving with McFi, SID 07 Digest, 2007, pp. 1003-1006.

* cited by examiner

DISPLAY DEVICE COMPRISING NORMAL/MULTIPLIED SPEED DRIVE SWITCHING CIRCUIT AND DATA DRIVER AND OPERATING METHOD THEREOF

INCORPORATION BY REFERENCE

This application claims the benefit of priority based on Japanese Patent Application No. 2009-186136, filed on Aug. 10, 2009, the disclosure of which is incorporated herein by reference.

BACKGROUND OF THE INVENTION

1. Field of the Invention

The present invention generally relates to a display device and a method of operating the same, and in particular relates to an improvement of data transfer inside a hold-type display device.

2. Description of the Related Art

In a liquid crystal display device, a voltage once written in each pixel electrode is held until the corresponding scanning line is next selected, so that transmitted light is kept constant during one frame period. Hence, whereas a CRT (cathode ray tube) is called as an impulse-type display device, the liquid crystal display device is called as hold-type display device.

It has been considered that a motion blur in displaying a moving image results from a slow response speed of liquid crystal in the liquid crystal display panel; however, it has been known recently that there the motion blur is inherently caused in a hold-type display device even though the response speed of the liquid crystal is improved.

In order to suppress such the motion blur inherent in the hold-type display, two approaches have been proposed: one proposed approach is to insert a black frame between every two adjacent frame images and the other is to insert one or more interpolation frame images between every two adjacent frame images, the interpolation frame image(s) being generated by interpolation on the basis of the motion vector between the two adjacent frame images. The insertion of black frames is disclosed in the following documents: Japanese Patent Application Publications Nos. P2002-215111A, P2009-165161A and Japanese Patent Gazette No. 4079793 B, N. Kimura et al., "New Technologies for Large-Sized High Quality LCD TV", SID05 Digest, p. 1735, K. Ono et al., SID06 Digest, "Progress of IPS-Pro Technology for LCD TV", p. 1954, and T. S. Kim et al., "Impulsive Driving Technique in S-PVA Architecture", SID06 Digest p. 1709. The insertion of the interpolation frame images is disclosed in Sang Soo Kim et al., "Distinguished Paper: Novel TFT-LCD Technology for Motion Blur Reduction Osing 120 Hz Driving with McFi", SID07 Digest p. 1003.

These driving methods, in which one or more additional frame image is inserted in every two adjacent frame images, are referred to as multiplied-speed driving, because the frame frequency is 120 Hz or more, whereas the conventional frame frequency is 60 Hz. It should be noted here that, the term "multiplied-speed driving" means a display panel driving at a frequency of N times of the conventional frame frequency (N being an integer of 2 or more) in the specification of the present application. It should be also noted that, the term "multiplied-speed drive processing" means image data processing in which an additional frame image(s) is inserted into every two frame images with the frame frequency of 60 Hz, in order to achieve the multiplied-speed driving.

FIG. 1 is a block diagram showing an example of the configuration of a liquid crystal display device 101 adapted to the multiplied-speed driving. The liquid crystal display device 101 is configured to receive image data 111 and synchronous signals 112 from an image rendering unit 102 (e.g., CPU) and to display images in response to the image data 111 and the synchronous signals 112. In this configuration, the synchronous signals 112 are a set of control signals used for timing control of the liquid crystal display device 101, including a horizontal synchronous signal Hsync and a vertical synchronous signal Vsync.

In detail, the liquid crystal display device 101 includes a multiplied-speed drive processing circuit 103, a frame memory 104, a timing controller 105, a gate driver 106, a data driver 107, reference grayscale voltage generator 108 and a liquid crystal display panel 109.

The multiplied-speed drive processing circuit 103 performs multiplied-speed drive processing on the image data 111 to thereby produce multiplied-speed drive image data 113. More specifically, the multiplied-speed drive processing circuit 103 produces a frame image to be additionally inserted from every two adjacent frame images contained in the image data 111, and produces image data with the produced frame image inserted therein as multiplied-speed drive image data 113. The frame image to be inserted may be a black image or a frame image obtained by interpolating corresponding two adjacent frame images. In addition, the multiplied-speed drive processing circuit 103 produces multiplied-speed drive processing synchronous signals 114 of formats adapted to the multiplied-speed display driving from the synchronous signals 112. The multiplied-speed drive processing circuit 103 uses the frame memory 104 as a work area for producing the multiplied-speed drive image data 113.

The timing controller 105 controls the operations of the respective components integrated within the liquid crystal display device 101. More specifically, the timing controller 105 receives the multiplied-speed drive image data 113 from the multiplied-speed drive processing circuit 103 and transfers the same to the data driver 107. Further, the timing controller 105 produces gate control signals 115 and data control signals 116 based on the multiplied-speed drive processing synchronous signals 114. The gate control signals 115 are supplied to the gate driver 106 and the data control signals 116 are supplied to the data driver 107.

The gate driver 106 drives the gate lines of the liquid crystal display panel 109 in response to the gate control signals 115, and the data driver 107 drives the data lines of the liquid crystal display panel 109 in response to the multiplied-speed drive image data 113 and the data control signals 116. The reference grayscale voltage generator 108 produces reference grayscale voltages V0 to Vm and supplies the same to the data driver 107 for controlling the relation between the grayscale level of each pixel described in the multiplied-speed drive image data 113 and the voltage level of the drive voltage with which each of the data lines is actually driven.

One drawback of a liquid crystal display device performing multiplied-speed driving is that the amount of the transferred image data is increased (for example, doubled) within the liquid crystal display device due to the multiplied-speed processing. More specifically, for example, in a case where a liquid crystal display panel has the number of pixels corresponding to the Full-HD (high definition) display, the amount of transferred image data from the timing controller to the data driver is determined depending on whether or not the multiplied-speed driving is performed as follows:

(1) Not executing the multiplied-speed driving

1920×1080×24 bits×60 Hz=2.986 Gbps (2) Executing the multiplied-speed driving

1920×1080×24 bits×120 Hz=5.972 Gbps

If the amount of transferred image data is increased, a high speed data transfer is required in the liquid crystal display device, and this may cause EMI (electromagnetic interference) from the data transfer line and increase the power consumption. In the liquid crystal display device 101 shown in FIG. 1, for example, a high speed data transfer is required for transferring the multiplied-speed drive image data 113 from the multiplied-speed drive processing circuit 103 to the timing controller 105 and transferring the multiplied-speed drive image data 113 from the timing controller 105 to the data driver 107. In addition, there arises a necessity of mounting a high speed interface for implementing a high speed data transfer to the data driver 107 or increasing the number of the data transfer lines connected to the data driver 107.

SUMMARY

In an aspect of the present invention, a display device is provided with: a display panel; a driver driving said display panel; and a controller adapted to perform multiplied-speed drive processing on original image data externally supplied thereto. The driver is adapted to drive said display panel by multiplied speed driving. When the driver performs the multiplied-speed driving, the controller generates multiplied-speed drive image data by performing the multiplied-speed drive processing on the original image data, generates compressed image data by compressing the multiplied-speed drive image data, and transfers the compressed image data to the driver. In this case, the driver decompresses the compressed image data to thereby reproduce the multiplied-speed drive image data, and drives the display panel in response to the reproduced multiplied-speed drive image data. When the driver does not perform the multiplied-speed driving, on the other hand, the controller transfers the original image data to the driver, and the driver drives the display panel in response to the original image data received from the controller.

The present invention effectively reduces the data transfer amount within the display device, eliminating the necessity of the high speed data transfer within the display device and also reducing the EMI and power consumption.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment (Overall Configuration)

Figure 1:
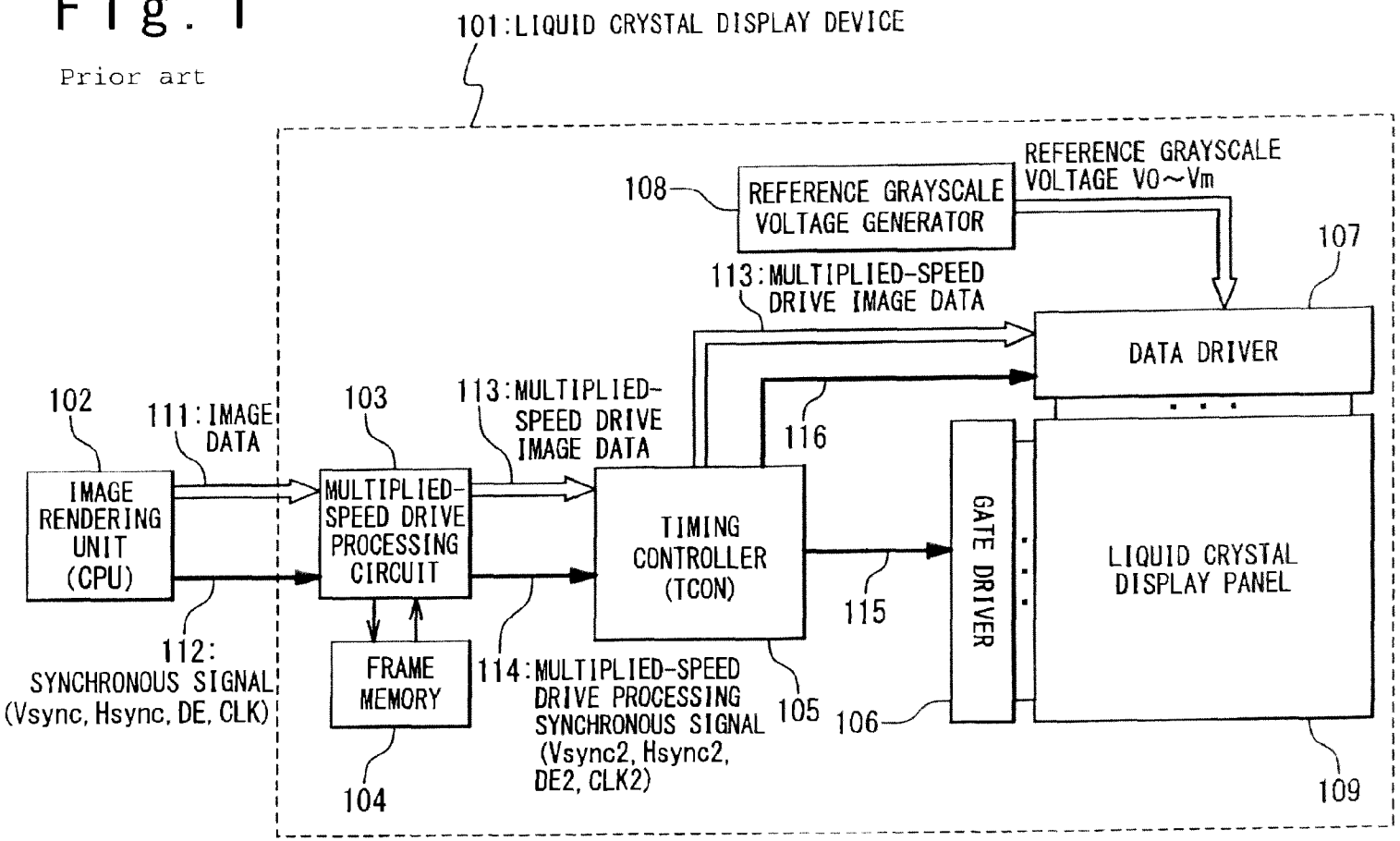
Fig. 1 Prior art
FIG. 1 is a block diagram showing an exemplary configuration of a conventional liquid crystal display device performing multiplied-speed driving.
Figure 2:
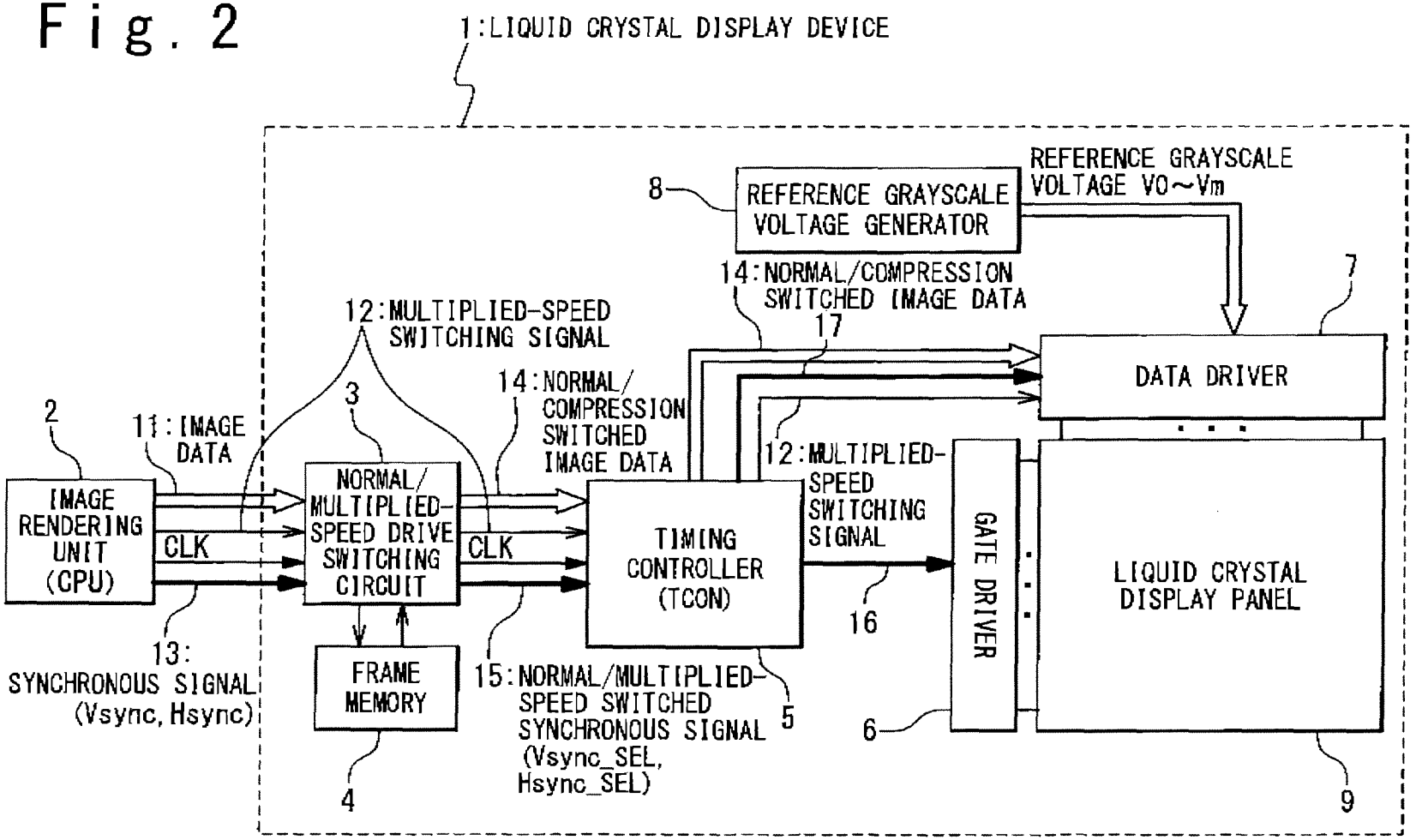
FIG. 2 is a block diagram showing an exemplary configuration of a liquid crystal display device in a first embodiment of the present invention.

FIG. 2 is a block diagram showing an exemplary configuration of a liquid crystal display device 1 in a first embodiment of the present invention. The liquid crystal display device 1 is configured to receive image data 11, a multiplied-speed switching signal 12, a clock signal CLK and synchronous signals 13 from an image rendering unit 2 (for example, a CPU) and to display images in response to these data and signals. The image data 11 are indicative of grayscale levels of the respective pixels, and the multiplied-speed switching signal 12 is a control signal which instructs the liquid crystal display device 1 to perform a multiplied-speed driving to. As described later, the liquid crystal display device 1 of this embodiment is configured to selectively perform the multiplied-speed driving in response to the multiplied-speed switching signal 12. The synchronous signals 13 are used for timing control of the liquid crystal display device 1 and include a horizontal synchronous signal Hsync and a vertical synchronous signal Vsync. As to be described later, the synchronous signals 13 are used for producing a horizontal synchronous signal and a vertical synchronous signal within the liquid crystal display device 1.

The liquid crystal display device 1 includes a normal/multiplied-speed drive switching circuit 3, a frame memory 4, a timing controller 5, a gate driver 6, a data driver 7, a reference grayscale voltage generator 8 and a liquid crystal display panel 9. In this embodiment, the normal/multiplied-speed drive switching circuit 3, the frame memory 4, the timing controller 5 and the data driver 7 are implemented as different integrated circuits.

The normal/multiplied-speed drive switching circuit 3 is used for performing multiplied-speed drive processing on the image data 11 when the multiplied-speed driving is demanded by the multiplied-speed switching signal 12. In this embodiment, the normal/multiplied-speed drive switching circuit 3 is adapted to further perform compression processing on the multiplied-speed drive image data produced by performing the multiplied-speed drive processing on the image data 11 to thereby produce compressed image data. In addition, the normal/multiplied-speed drive switching circuit 3 is also adapted to output the image data 11 without change when the multiplied-speed driving is not demanded. The operation of the normal/multiplied-speed drive switching circuit 3 is switched in response to the multiplied-speed switching signal 12. When the multiplied-speed switching signal 12 is asserted, the normal/multiplied-speed drive switching circuit 3 produces the multiplied-speed drive image data and the compressed image data, and outputs the compressed image data. When the multiplied-speed switching signal 12 is negated, on the other hand, the normal/multiplied-speed drive switching circuit 3 outputs the image data 11 without change. In the following description, the image data (i.e., image data 11 or compressed image data) outputted from the normal/multiplied-speed drive switching circuit 3 are referred to as normal/compression switched image data 14.

In addition, the normal/multiplied-speed drive switching circuit 3 produces normal/multiplied-speed switched synchronous signals 15 from the synchronous signals 13. Herein, the normal/multiplied-speed switched synchronous signals 15 are a set of control signals including a vertical synchronous signal Vsync_SEL and a horizontal synchronous signal Hsync_SEL used for the timing control within the liquid crystal display device 1. The frequencies of the vertical synchronous signal Vsync_SEL and the horizontal synchronous signal Hsync_SEL are switched between the case of performing the multiplied-speed driving and the case of not performing the same. The normal/multiplied-speed drive switching circuit 3 further transfers the multiplied-speed switching signal 12 and the clock signal CLK to the timing controller 5.

The frame memory 4 is connected with the normal/multiplied-speed drive switching circuit 3 and is used as a work area when the normal/multiplied-speed drive switching circuit 3 performs the multiplied-speed drive processing on the image data 11.

The timing controller 5 controls the operation of the respective components within the liquid crystal display device 1. More specifically, the timing controller 5 receives the normal/compression switched image data 14 from the normal/multiplied-speed drive switching circuit 3 and transfers the same to the data driver 7. Moreover, the timing controller 5 produces gate control signals 16 and data control signals 17 based on the normal/multiplied-speed switched synchronous signals 15, supplies the gate control signals 16 to the gate driver 6, and supplies the multiplied-speed switching signal 12 and the data control signal 17 to the data driver 7.

The gate driver 6 drives the gate lines in the liquid crystal display panel 9 in response to the gate control signals 16.

The data driver 7 drives the data lines in the liquid crystal display panel 9 in response to the normal/compression switched image data 14 and the data control signals 17. When the data driver 7 receives the image data 11 (i.e., image data not subjected to multiplied-speed drive processing and compression processing) as the normal/compression switched image data 14, the data driver 7 drives the data lines in the liquid crystal display panel 9 in response to the image data 11. When the compressed image data are received as the normal/compression switched image data 14, on the other hand, the data driver 7 decompresses the compressed image data to reproduce the multiplied-speed drive image data, and drives the data lines in the liquid crystal display panel 9 in response to the reproduced multiplied-speed drive image data. The operation of the data driver 7 is switched in response to the multiplied-speed switching signal 12 received from the timing controller 5. The configuration and operation of the data driver 7 will be described in details later.

The reference grayscale voltage generator 8 supplies reference grayscale voltages V0 to Vm to the data driver 7. The reference grayscale voltages V0 to Vm are used for controlling the relation between the grayscale value of each pixel described in the normal/compression switched image data 14 and the voltage level of the drive voltage with which the corresponding data line is actually driven.

In the following, a detailed description is given of the configuration of the normal/multiplied-speed drive switching circuit 3 and the data driver 7.

Figure 3:
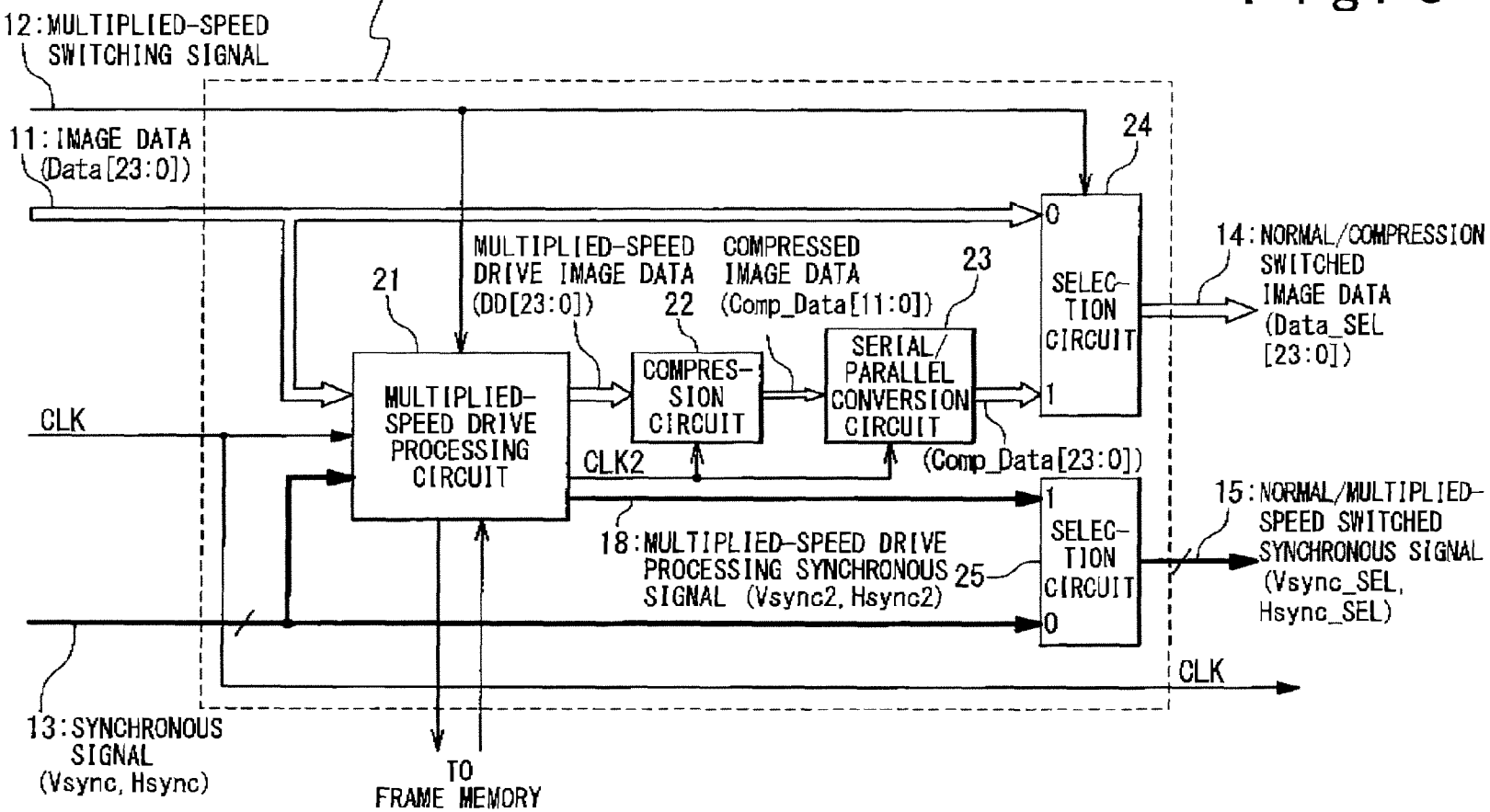
FIG. 3 is a block diagram showing an exemplary configuration of a normal/multiplied-speed drive switching circuit in the first embodiment.

FIG. 3 is a block diagram showing an exemplary configuration of the normal/multiplied-speed drive switching circuit 3 in this embodiment. In FIG. 3, the configuration of the normal/multiplied-speed drive switching circuit 3 is shown assuming that the image data 11 and the normal/compression switched image data 14 are both 24-bit data. The image data 11 and the normal/compression switched image data 14 may be referred to as image data Data[23:0] and normal/compression switched image data Data_SEL[23:0], respectively, in order to emphasize that the image data 11 and the normal/compression switched image data 14 are both 24-bit data.

The normal/multiplied-speed drive switching circuit 3 includes a multiplied-speed drive processing circuit 21, a compression circuit 22, a serial/parallel conversion circuit 23 and selection circuits 24 and 25.

When the multiplied-speed switching signal 12 is asserted, the multiplied-speed drive processing circuit 21 performs three operations as follows: First, the multiplied-speed drive processing circuit 21 performs the multiplied-speed drive processing on the image data Data[23:0] to produce the multiplied-speed drive image data DD[23:0], which are used for the multiplied-speed driving. Second, the multiplied-speed drive processing circuit 21 produces multiplied-speed drive processing synchronous signals 18 which are adapted to the multiplied-speed driving from the synchronous signals 13. The multiplied-speed drive processing synchronous signals 18 include a vertical synchronous signal Vsync2 and a horizontal synchronous signal Hsync2 having the frequencies of m times (twice in this embodiment) of those of the vertical synchronous signal Vsync and the horizontal synchronous signal Hsync, respectively. Third, the multiplied-speed drive processing circuit 21 performs m-fold frequency multiplication (two-fold in this embodiment) of the clock signal CLK and produces a clock signal CLK2. The multiplied-speed drive image data DD[23:0] are outputted from the multiplied-speed drive processing circuit 21 in synchronization with the clock signal CLK2. When the multiplied-speed switching signal 12 is negated, on the other hand, the multiplied-speed drive processing circuit 21 stops the operation to reduce the power consumption. The multiplied-speed drive processing circuit 21 is connected with the frame memory 4 and uses the frame memory 4 as a work area.

The compression circuit 22 performs a compression-process on the multiplied-speed drive image data DD[23:0] to produce compressed image data Comp_Data[11:0]. In this embodiment, the compressed image data Comp_Data[11:0] are 12-bit data. The compression circuit 22 is supplied with the clock signal CLK2 and operates in synchronization with the clock signal CLK2.

The serial/parallel conversion circuit 23 performs a serial/parallel conversion of a ration of 1:2 on the compressed image data Comp_Data[11:0], which are 12-bit data, to output corresponding 24-bit data. The serial/parallel conversion circuit 23 is supplied with the clock signal CLK2 and operates in synchronization with the clock signal CLK2.

The selection circuit 24 selects between the image data Data[23:0] and the compression image data received from the serial/parallel conversion circuit 23 in response to the multiplied-speed switching signal 12, and outputs the selected image data as normal/compression switched image data Data_SEL[23:0]. More specifically, when the multiplied-speed switching signal 12 is asserted, the selection circuit 24 selects the compressed image data received from the serial/parallel conversion circuit 23 as the normal/compression switched image data Data_SEL[23:0]. When the multiplied-speed switching signal 12 is negated, the selection circuit 24 selects the image data Data[23:0] as the normal/compression switched image data Data_SEL[23:0].

Similarly, the selection circuit 25 selects between the synchronous signals 13 and the multiplied-speed drive processing synchronous signals 18 in response to the multiplied-speed switching signal 12, and outputs the selected synchronous signals as a normal/multiplied-speed switched synchronous signals 15. More specifically, when the multiplied-speed switching signal 12 is asserted, the selection circuit 24 selects the multiplied-speed drive processing synchronous signals 18 as the normal/multiplied-speed switched synchronous signals 15. When the multiplied-speed switching signal 12 is negated, the selection circuit 24 selects the synchronous signals 13 as the normal/multiplied-speed switched synchronous signals 15.

Figure 4A:
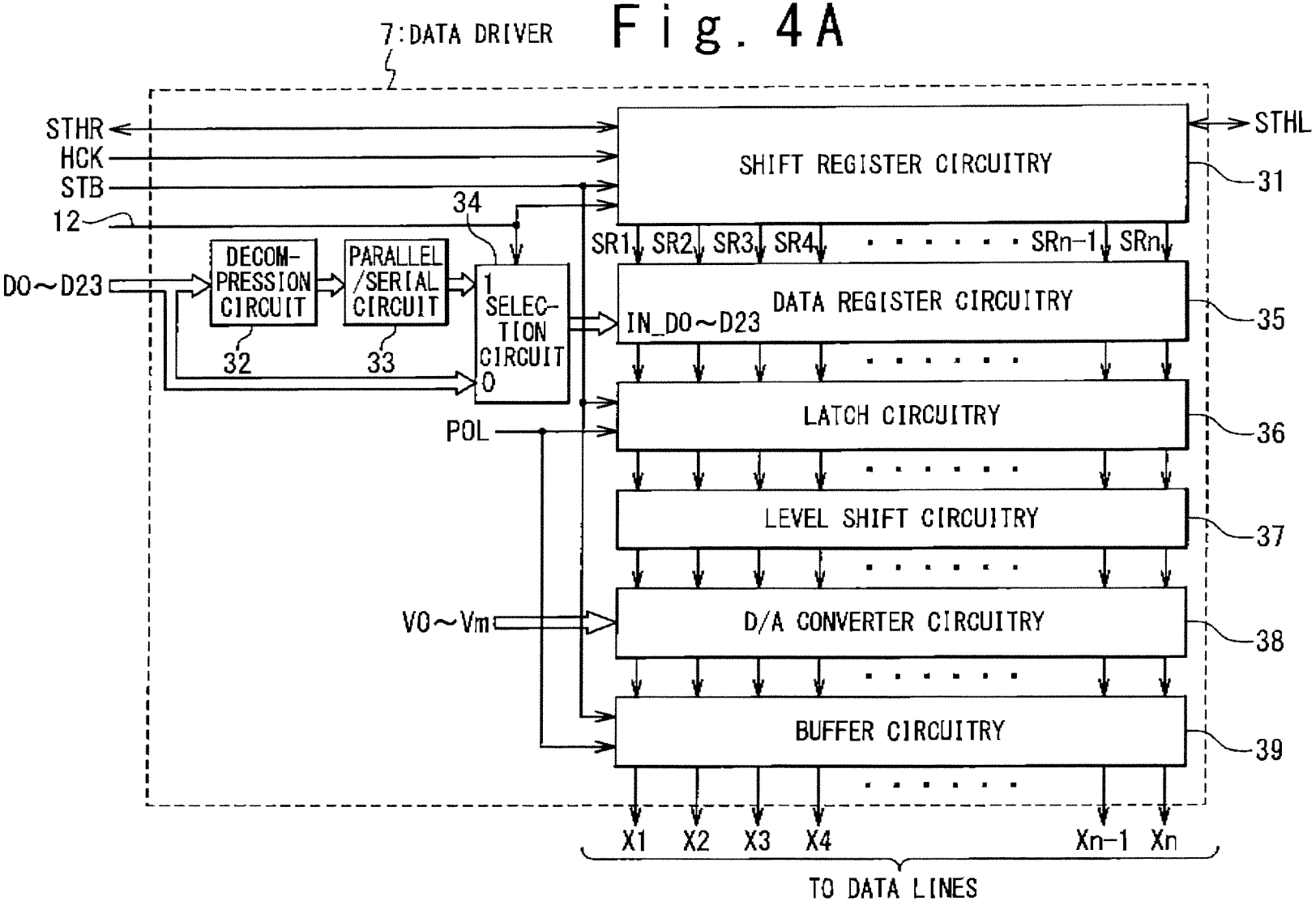
FIG. 4A is a block diagram showing an exemplary configuration of a data driver in the first embodiment.
Figure 4B:
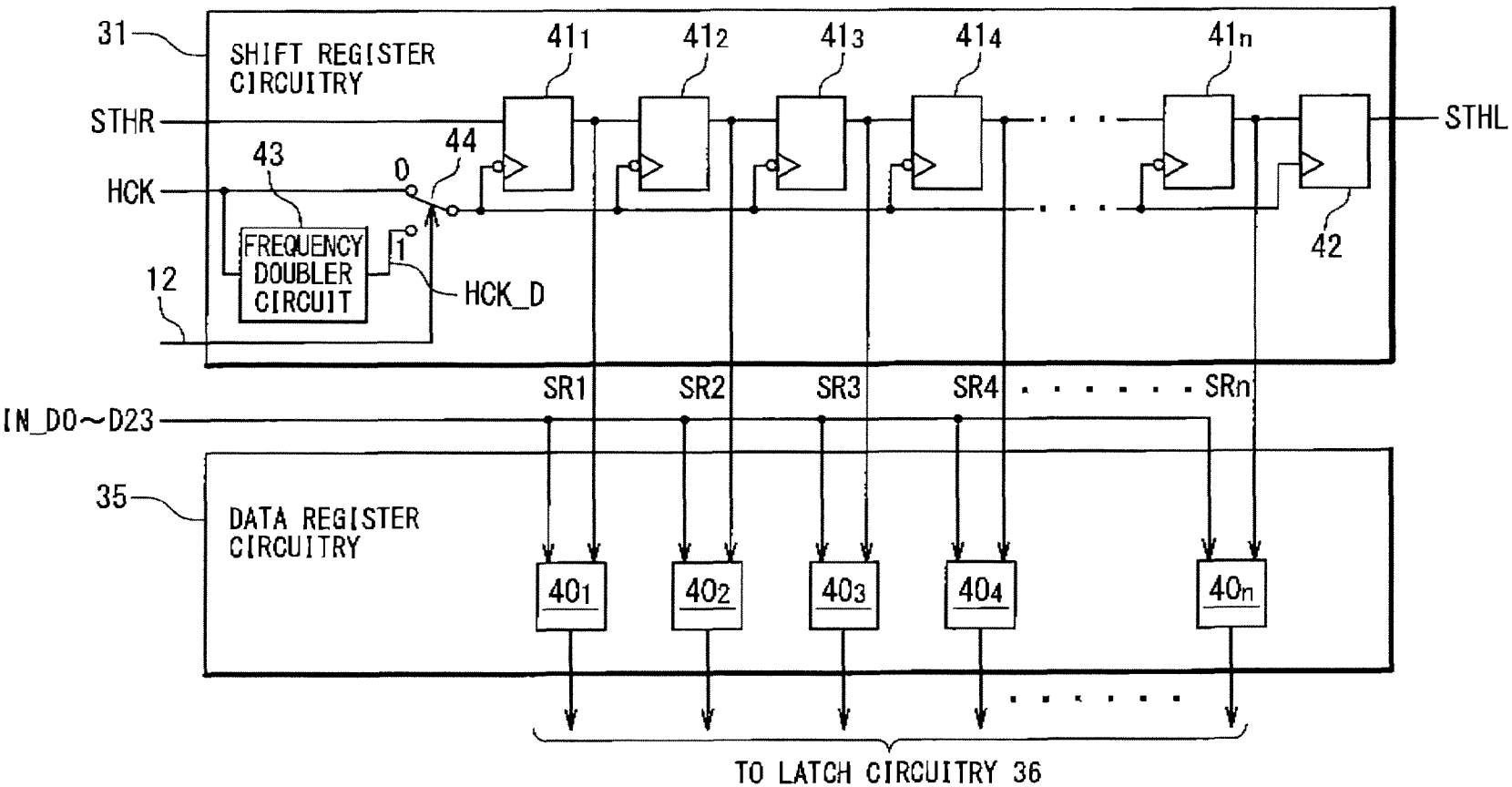
FIG. 4B is a block diagram showing an exemplary configuration of a shift register circuitry and a data register circuitry in the first embodiment.
Figure 4C:
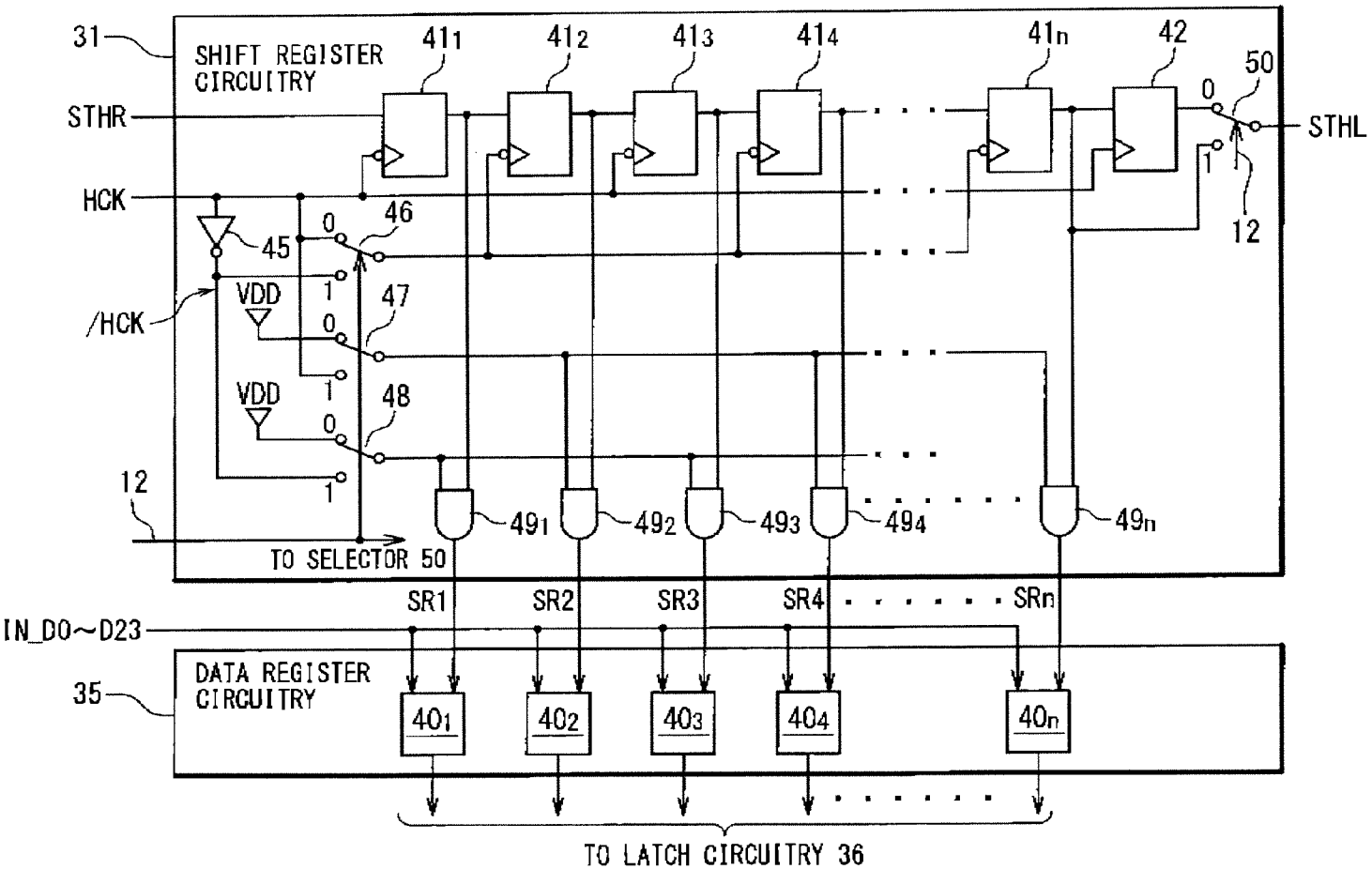
FIG. 4C is a block diagram showing an exemplary configuration of the shift register circuitry and the data register circuitry according to the first embodiment.

Meanwhile, FIG. 4A is a block diagram showing an exemplary configuration of the data driver 7 in this embodiment. The data driver 7 includes a shift register circuitry 31, a decompression circuit 32, a parallel/serial circuit 33, a selection circuit 34, a data register circuitry 35, a latch circuitry 36, a level shift circuitry 37, a D/A converter circuitry 38 and a buffer circuitry 39. As shown in FIGS. 4B and 4C, the data register circuitry 35 includes latch circuits $\mathbf{40}_1$ to $\mathbf{40}_n$ associated with the data lines X1 to Xn, respectively.

The shift register circuitry 31 operates as a latch controller which supplies latch signals SR1 to SRn instructing the latch circuits $\mathbf{40}_1$ to $\mathbf{40}_n$ in the data register circuitry 35 to perform latch operations. More specifically, the shift register circuitry 31 performs a shift operation in response to a start pulse signal STHR, a clock signal HCL and a strobe signal STB, and sequentially asserts the latch signals SR1 to SRn (pulls up the latch signals SR1 to SRn to the high level in this embodiment). Herein, the start pulse signal STHR is a signal for instructing the data driver 7 to capture the normal/compression switched image data 14. In this embodiment, the data driver 7 captures the normal/compression switched image data 14 in response to the assertion of the start pulse signal STHR. The clock signal HCK is one of the data control signals 17 supplied from the timing controller 5.

The shift register circuitry 31 has a configuration such that the time intervals of sequentially asserting the latch signals SR1 to SRn in response to the multiplied-speed switching signal 12 can be switched. More specifically, when the multiplied-speed switching signal 12 is negated, the latch signals SR1 to SRn are sequentially asserted in synchronization with falling edges of the clock signal HCK. When the multiplied-speed switching signal 12 is asserted, on the other hand, the latch signals SR1 to SRn are sequentially asserted in synchronization with both of the rising and falling edges of the clock signal HCK.

FIGS. 4B and 4C are block diagrams showing examples of the configuration of the shift register circuitry 31 for executing these operations. In the configuration shown in FIG. 4B, the shift register circuitry 31 includes flip-flops $\mathbf{41}_1$ to $\mathbf{41}_n$ connected in series, an output flip-flop 42, a frequency doubler 43 and a selector 44. The frequency doubler 43 doubles the frequency of the clock signal HCK to produce a frequency-doubled clock signal HCK_D. The selector 44 selects between the clock signal HCK and the frequency-doubled clock signal HCK_D in response to the multiplied-speed switching signal 12, and supplies the selected clock signal to each of the clock terminals of the flip-flops $\mathbf{41}_1$ to $\mathbf{41}_n$. The flip-flops $\mathbf{41}_1$ to $\mathbf{41}_n$ are used for producing the latch signals SR1 to SRn by the shift operation. The flip-flop $\mathbf{41}_1$ latches the start pulse signal STHR in response to the pull-down of the clock signal selected by the selector 44 (the clock signal HCK or frequency-doubled clock signal HCK_D). The output signal of the flip-flop $\mathbf{41}_1$ is outputted as the latch signal SR1 to the data register circuitry 35 and is also supplied to the flip-flop $\mathbf{41}_2$. The flip-flop $\mathbf{41}_2$ latches the output signal of the flip-flop $\mathbf{41}_1$ in response to the pull-down of the clock signal selected by the selector 44. The output signal of the flip-flop $\mathbf{41}_1$ is supplied as the latch signal SR2 to the data register circuitry 35 and is also supplied to the flip-flop $\mathbf{41}_3$. The flip-flops $\mathbf{41}_3$ to $\mathbf{41}_n$ produce the latch signals SR3 to SRn in the same way. The output flip-flop 42 latches the output signal (latch signal SRn) of the flip-flop $\mathbf{41}_n$ in response to the pull-up of the clock signal selected by the selector 44. The output signal of the output flip-flop 42 is supplied as the shift pulse signal STHL to a neighboring data driver. In the configuration shown in FIG. 4B, the time intervals of sequentially asserting the latch signals SR1 to SRn are switched by switching the frequency of the clock signal for operating the flip-flops $\mathbf{41}_1$ to $\mathbf{41}_n$.

In the configuration shown in FIG. 4C, on the other hand, the shift register circuitry 31 includes flip-flops $\mathbf{41}_1$ to $\mathbf{41}_n$ connected in series, an output flip-flop 42, an inverter 45, selectors 46 to 48, AND gates $\mathbf{49}_1$ to $\mathbf{49}_n$ and a selector 50. The inverter 45 inverts the clock signal HCK to produce an inverted clock signal /HCK. The selector 46 selects between the clock signal HCK and the inverted clock signal /HCK in response to the multiplied-speed switching signal 12, and outputs the selected clock signal. The selector 47 selects between the clock signal HCK and the high level signal (VDD) in response to the multiplied-speed switching signal 12. On the other hand, the selector 48 selects between the inverted clock signal /HCK and the high level signal in response to the multiplied-speed switching signal 12. Each of the flip-flops $\mathbf{41}_1$ to $\mathbf{41}_n$ latches the start pulse signal STHR or the output signal of the preceding flip-flop 41. In this configuration, the odd-numbered flip-flop $\mathbf{41}_{2i-1}$ of the flip-flops $\mathbf{41}_1$ to $\mathbf{41}_n$ performs the latch operation in synchronization with the pull-down of the clock signal HCK, and the even-numbered flip-flop $\mathbf{41}_{2i}$ performs the latch operation in synchronization with the pull-down of the clock signal selected by the selector 46 (the clock signal HCK or inverted clock signal /HCK). The odd-numbered AND gate $\mathbf{49}_{2i-1}$ produces the logical AND of the output of the odd-numbered flip-flop $\mathbf{41}_{2i-1}$ and the output of the selector 48, and the even-numbered AND gate $\mathbf{49}_{2i}$ produces the logical AND of the output of the even-numbered flip-flop $\mathbf{41}_{2i}$ and the output of the selector 47. The output signals of the AND gates $\mathbf{49}_1$ to $\mathbf{49}_n$ are used as the latch signals SR1 to SRn. The output flip-flop 42 latches the output signal (latch signal SRn) of the flip-flop $\mathbf{41}_n$ in response to pull-up of the clock signal. The selector 50 selects between the output signal of the last flip-flop $\mathbf{41}_n$ and the output signal of the output flip-flop 42 in response to the multiplied-speed switching signal 12. The output signal selected by the selector 50 is supplied as the shift pulse signal STHL to a neighboring data driver. In the configuration shown in FIG. 4C, the time intervals of sequentially asserting the latch signals SR1 to SRn are switched by switching between the shift operation synchronized with the falling edges of the clock signal HCK and the shift operation synchronized with both of the falling edges of the clock signal HCK and the inverted clock signal /HCK.

Referring back to FIG. 4A, the decompression circuit 32 decompresses the compressed image data to produce the decompressed image data, when the normal/compression switched image data 14 are the compressed image data. The parallel/serial conversion circuit 33 performs the parallel/serial conversion on the decompressed image data to reproduce the multiplied-speed drive image data DD[23:0].

The selection circuit 34 selects between the output data (i.e., multiplied-speed drive image data DD[23:0]) of the parallel/serial conversion circuit 33 and the normal/compression switched image data 14 received from the timing controller 5 in response to the multiplied-speed switching signal 12, and outputs the selected data to the data register circuitry 35. More specifically, when the multiplied-speed switching signal 12 is asserted, the selection circuit 34 selects the multiplied-speed drive image data DD[23:0], and when the multiplied-speed switching signal 12 is negated, the selection circuit 34 selects the normal/compression switched image data 14. In this operation, the image data Data[23:0] are supplied as the normal/compression switched image data 14 when the multiplied-speed switching signal 12 is negated, and therefore, the selection circuit 34 supplies the multiplied-speed drive image data DD[23:0] or the image data Data[23:0] to the data register circuitry 35.

The data register circuitry 35, the latch circuitry 36, the level shift circuitry 37, the D/A converter circuitry and the buffer circuitry 39 constitute a drive circuitry which drives the n data lines of the liquid crystal display panel 9 in response to the multiplied-speed drive image data DD[23:0] or the image data Data[23:0]. In FIG. 4A, the n data lines are denoted by reference symbols X1 to Xn.

More specifically, the data register circuitry 35 receives the image data from the selection circuit 34 (the multiplied-speed drive image data DD[23:0] or image data Data[23:0]) and holds the same therein. Specifically, as shown in FIGS. 4B and 4C, the data register circuitry 35 includes latch circuits $\mathbf{40}_1$ to $\mathbf{40}_n$ associated with the data lines X1 to Xn, respectively. When the latch signal SRi supplied from the shift register 31 is asserted, the corresponding latch circuit $\mathbf{40}_i$ receives and holds the image data corresponding to the liquid crystal pixel connected to the corresponding data line Xi.

The latch circuitry 36 latches the image data from the data register circuitry 35. The latch circuitry 36 is responsive to the strobe signal STB; the latch circuitry 36 simultaneously latches the image data from all of the latch circuits $\mathbf{40}_1$ to $\mathbf{40}_n$ in response to the assertion of the strobe signal STB.

The level shift circuitry 37 provides signal level matching between the output signals of the latch circuits $\mathbf{40}_1$ to $\mathbf{40}_n$ and the input signals of the D/A converter circuitry 38. The decompressed image data outputted from the latch circuits $\mathbf{40}_1$ to $\mathbf{40}_n$ are transferred to the D/A converter circuitry 38 through the level shift circuitry 37.

The D/A converter circuitry 38 provides digital-to-analog conversion of the image data transferred from the latch circuitry 36 to thereby produce grayscale voltages having the voltage levels corresponding to the grayscale levels indicated by the image data. Specifically, the D/A converter circuitry 38 produces the grayscale voltages respectively corresponding to the allowed grayscale levels of the image data, in response to the reference grayscale voltages V0 to Vm supplied from the reference grayscale voltage generator 8. The reference grayscale voltages V0 to Vm are used for controlling the produced grayscale voltages. Further, the D/A converter circuitry 38 selects the grayscale voltages corresponding to the grayscale levels indicated by the image data transferred from the latch circuitry 36 and outputs the selected grayscale voltages.

The buffer circuitry 39 includes buffers (e.g., voltage followers constituted by operational amplifiers) respectively associated with the data lines X1 to Xn, and drives the data lines X1 to Xn with the drive voltages identical to the grayscale voltages supplied from the D/A converter circuitry 38. Thus, the liquid crystal pixels connected to the data lines X1 to Xn are driven with desired drive voltages.

(Operation of Liquid Crystal Display Device)

Next, a description is given of an exemplary operation of the liquid crystal display device 1 of this embodiment.

The liquid crystal display device 1 of this embodiment is adapted to perform multiplied-speed driving in response to the image data 11. When the multiplied-speed driving is performed, the normal/multiplied-speed drive switching circuit 3 performs multiplied-speed drive processing on the image data 11 to produce the multiplied-speed drive image data, and then perform compression processing on the multiplied-speed drive image data to produce the compressed image data. The compressed image data produced from the multiplied-speed drive image data are transferred to the data driver 7 through the timing controller 5. The data driver 7 decompresses the compressed image data to reproduce the multiplied-speed drive image data, and drives the data lines X1 to Xn by the multiplied-speed driving in response to the multiplied-speed drive image data.

Such an operation of the liquid crystal display device 1 effectively reduces the amount of transfer data from the normal/multiplied-speed drive switching circuit 3 to the timing controller 5 and the amount of transfer data from the timing controller 5 to the data driver 7, since the multiplied-speed drive image data are transferred inside the liquid crystal display device 1 after compressing the multiplied-speed drive image data. The reduction in the data transfer amount eliminates the need for a high-speed data transfer within the liquid crystal display device 1 and effectively reduces the EMI from the data transfer line and the power consumption.

Furthermore, the liquid crystal display device 1 is adapted to display images in response to the image data 11 without executing the multiplied-speed driving. In this case, the normal/multiplied-speed drive switching circuit 3 outputs the image data 11 received from the image rendering unit 2 without change. The image data 11 are transferred to the data driver 7 through the timing controller 5. The data driver 7 drives the data lines X1 to Xn in response to the image data 11.

Switching execution/inexecution of the multiplied-speed driving is effective to reduce the power consumption. The multiplied-speed driving effectively improves the quality of moving images; however, the frame frequency is increased and the power consumption is increased. Therefore, the multiplied-speed driving is performed in displaying moving images; the multiplied-speed driving is not performs in displaying a still picture. This effectively suppresses the motion blur, while preventing the power consumption from being increased.

In the following, a detailed description is given of the operations of the respective components of the liquid crystal display device 1.

Figure 5:
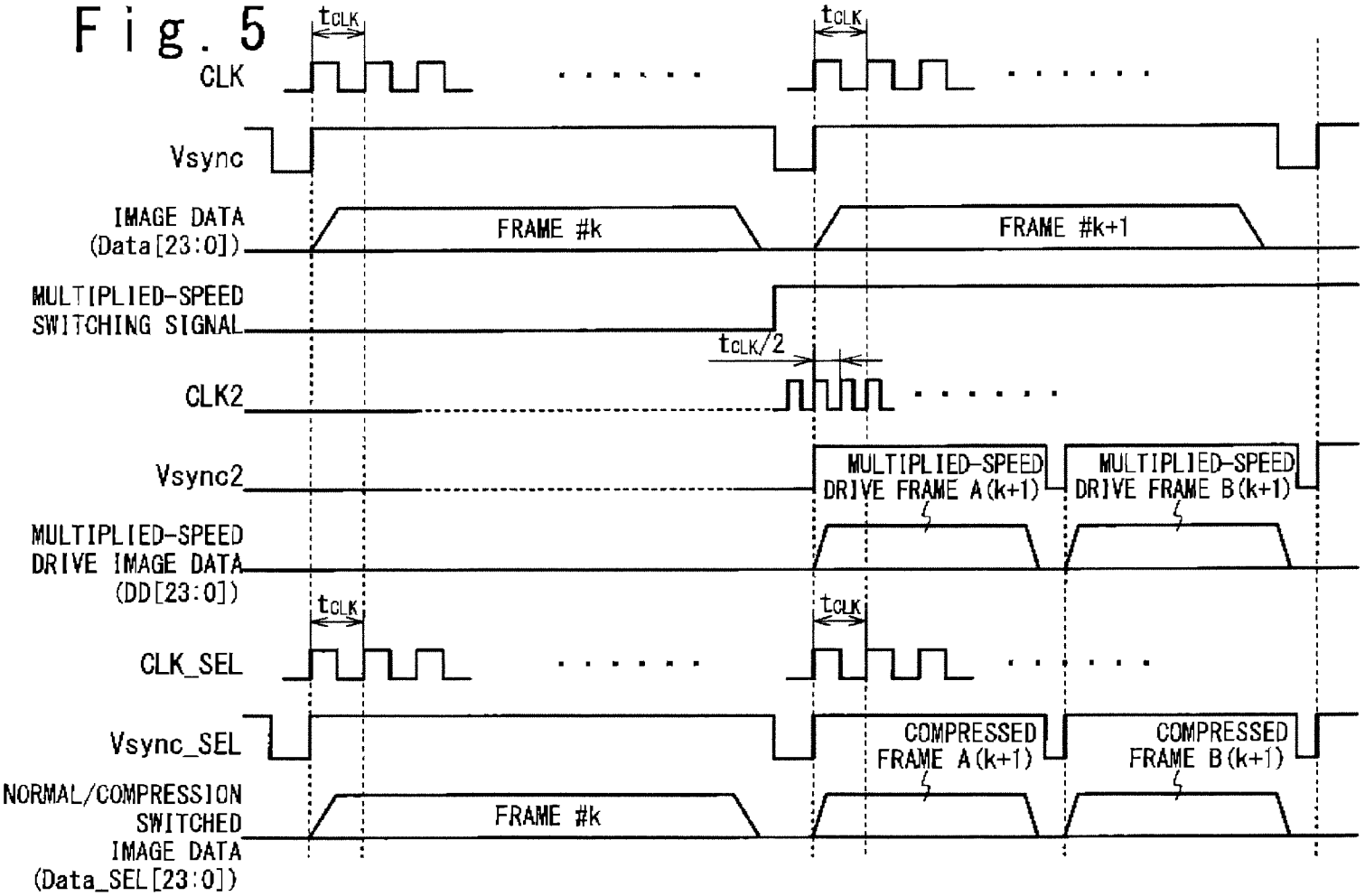
FIG. 5 is a timing chart showing an exemplary operation of the normal/multiplied-speed drive switching circuit in the first embodiment.

FIG. 5 is a timing chart showing an operation of the normal/multiplied-speed drive switching circuit 3. FIG. 5 shows an operation in a case when the normal drive operation is performed in response to negation of the multiplied-speed switching signal 12 in a frame #k whereas the multiplied-speed driving is performed in response to assertion of the multiplied-speed switching signal 12 in the following frame #k+1.

When the normal drive operation is performed in response to the negation of the multiplied-speed switching signal 12, the normal/multiplied-speed drive switching circuit 3 outputs the vertical synchronous signal Vsync_SEL with a frequency of 60 Hz and outputs the image data Data[23:0] supplied from the image rendering unit 2 without change.

When the multiplied-speed driving is performed in response to the assertion of the multiplied-speed switching signal 12, on the other hand, the normal/multiplied-speed drive switching circuit 3 outputs the vertical synchronous signal Vsync_SEL with a frequency of 120 Hz, and outputs 24-bit data obtained by the serial/parallel-conversion of the compressed image data Comp_Data[11:0] as the normal/compression switched image data Data_SEL[23:0]. In this case, the normal/multiplied-speed drive switching circuit 3 produces a clock signal CLK2 having a frequency of the double of the frequency of the clock CLK and produces the multiplied-speed drive image data DD[23:0], and compresses the multiplied-speed drive image data DD[23:0] to produce the compressed image data Comp_Data[11:0]. In FIG. 5, "multiplied-speed drive frame A(k+1)" represents the multiplied-speed drive image data DD[23:0] of a frame image produced previously in the time domain out of a pair of frame images produced in accordance with the image of frame #k+1. Similarly, "multiplied-speed drive frame B (k+1)" represents multiplied-speed drive image data DD[23:0] of the frame image produced latterly in the time domain out of the pair of frame images produced in accordance with the image of frame #k+1. Similarly, "compressed frame A(k+1)" represents compressed image data obtained by compressing the multiplied-speed drive image data DD[23:0] of the frame image produced previously in the time domain, and "compressed frame B(k+1)" represents compressed image data obtained by compressing the multiplied-speed drive image data DD[23:0] of the frame image produced latterly in the time domain.

Figure 6:
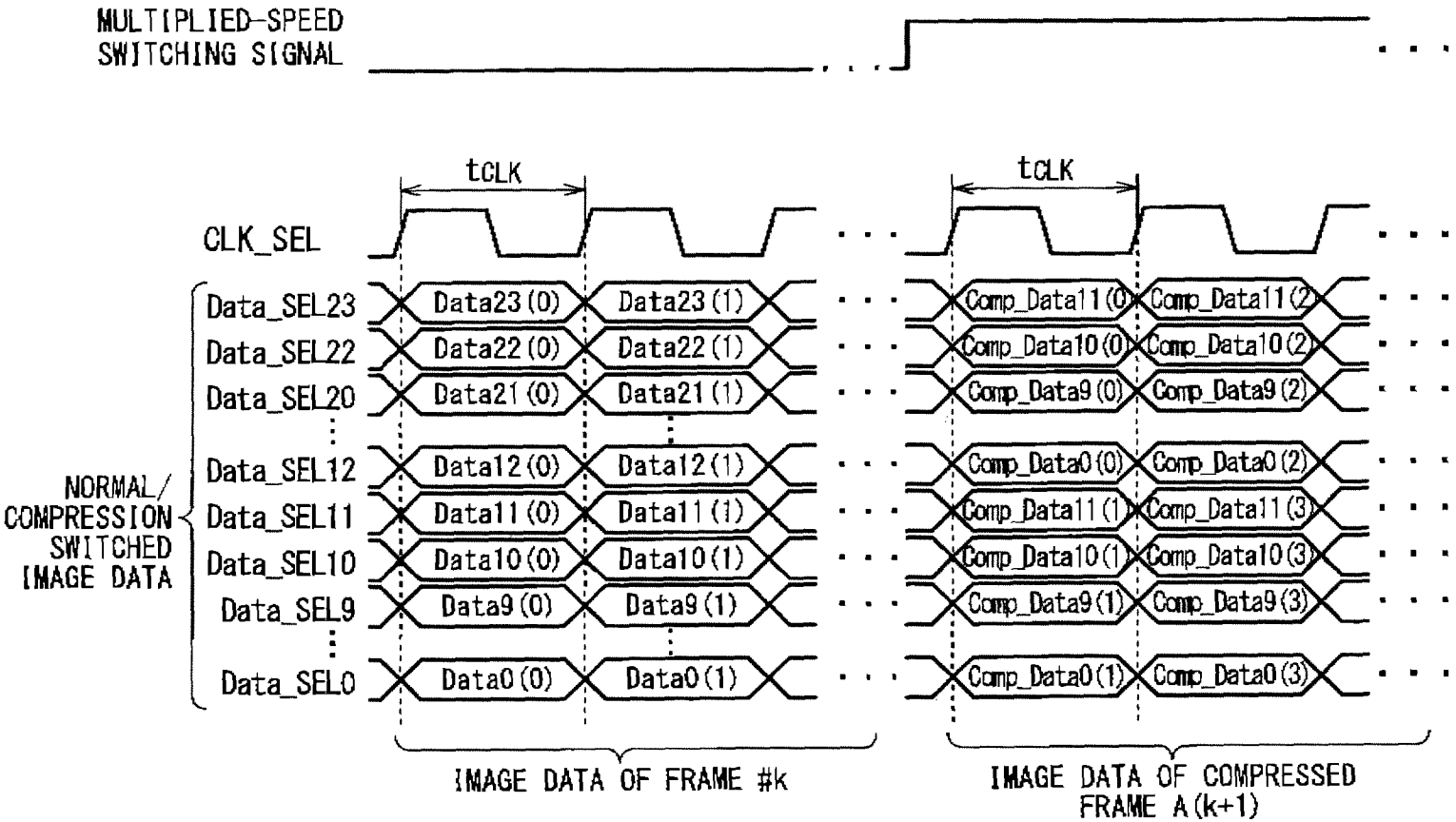
FIG. 6 is a diagram showing a format of normal/compression switched image data according to the first embodiment.

FIG. 6 is a diagram specifically showing the format of the normal/compression switched image data Data_SEL[23:0] outputted from the normal/multiplied-speed drive switching circuit 3. Herein, Data_SEL0 to Data_SEL23 represent the respective bits of the normal/compression switched image data Data_SEL[23:0].

In performing the normal drive operation in response to the negation of the multiplied-speed switching signal 12, the image data Data[23:0] are outputted from the normal/multiplied-speed drive switching circuit 3 as the normal/compression switched image data Data_SEL[23:0]. In FIG. 6, Data0(*i*) to Data23(*i*) represent respective bits of image data Data[23:0] of the i-th pixel in the horizontal line of interest. In this case, the j-th bit of the image data Data[23:0] is selected as the j-th bit of the normal/compression switched image data Data_SEL[23:0], and the image data Data[23:0] of one pixel are outputted from the normal/multiplied-speed drive switching circuit 3 in each clock cycle.

In performing the multiplied-speed driving in response to the assertion of the multiplied-speed switching signal 12, on the other hand, the data obtained by the serial/parallel conversion of the compressed image data Comp_Data[11:0] produced by the compression circuit 22 are outputted from the normal/multiplied-speed drive switching circuit 3 as the normal/compression switched image data Data_SEL[23:0]. In FIG. 6, Comp_Data 0(*i*) to Comp_Data 11(*i*) represents respective bits of the compressed image data Comp_Data[11:0] associated with the i-th pixel in the horizontal line of interest. At this time, the bits of the compressed image data Comp_Data[11:0] of the 2k-th pixel are used as the higher 12 bits of the normal/compression switched image data Data_SEL[23:0], and the bits of the compressed image data Comp_Data[11:0] of the (2k+1)-th pixel are used as the lower 12 bits of the normal/compression switched image data Data_SEL[23:0]. Therefore, the compressed image data Comp_Data[11:0] of two pixels are outputted from the normal/multiplied-speed drive switching circuit 3 in each clock cycle.

Figure 7:
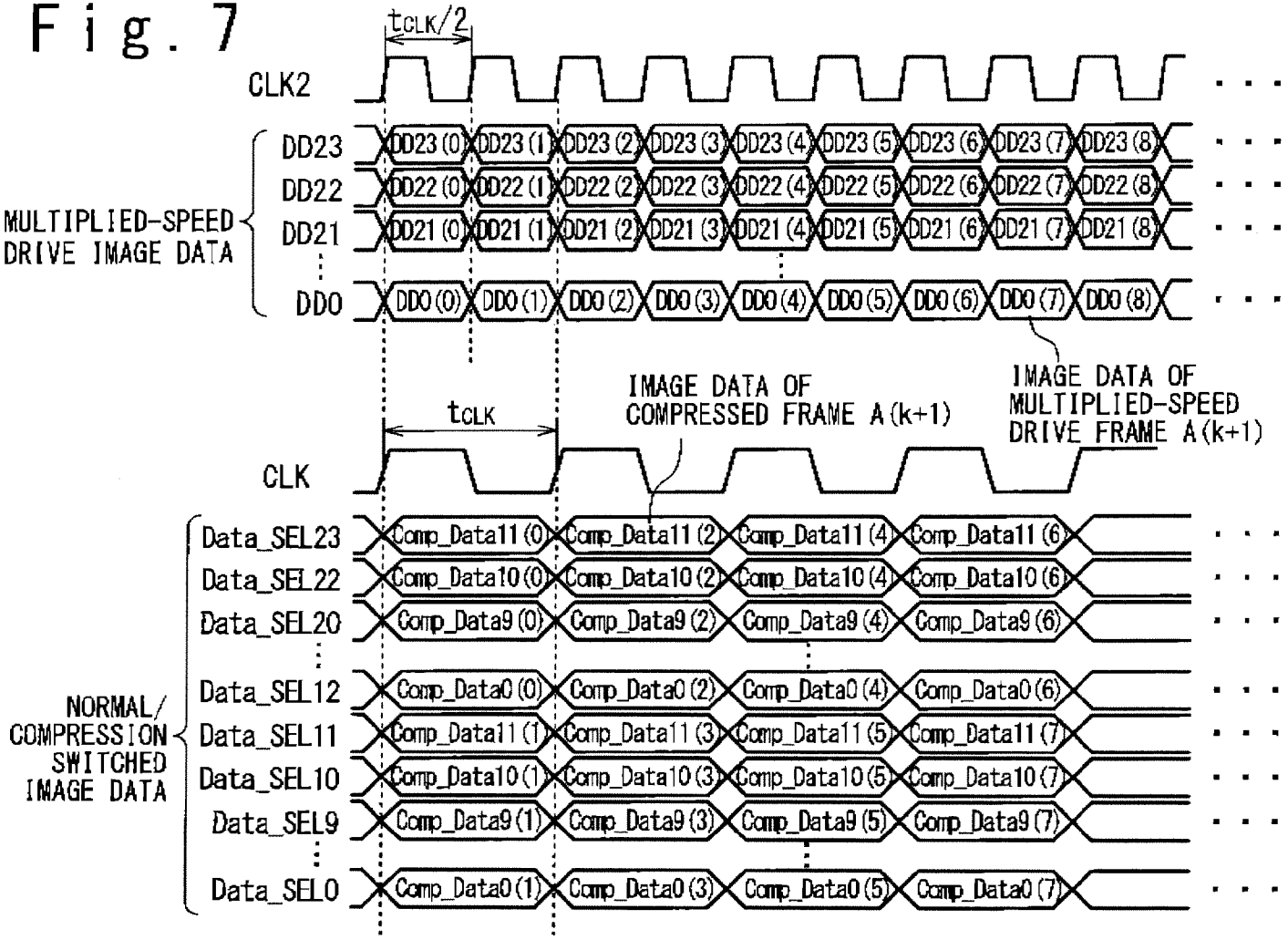
FIG. 7 is a diagram showing the relation between the multiplied-speed drive image data and the normal/compression switched image data in the first embodiment.

FIG. 7 shows the relations of the multiplied-speed drive image data DD[23:0] produced by the multiplied-speed drive processing circuit 21, the compressed image data Comp_Data[11:0] produced by the compression circuit 22 and the normal/compression switched image data Data_SEL[23:0] finally outputted from the normal/multiplied-speed drive switching circuit 3. In FIG. 7, DD0(*i*) to DD23(*i*) represent the respective bits of the multiplied-speed drive image data DD[23:0] associated with the i-th pixel on the horizontal line of interest.

As shown in FIG. 7, the multiplied-speed drive image data DD[23:0] are produced in synchronization with the clock signal CLK2, which has a frequency of the double of the frequency of the clock signal CLK, within the normal/multiplied-speed drive switching circuit 3. The compressed image data Comp_Data[11:0] are produced by compressing the multiplied-speed drive image data DD[23:0] to have the half data amount thereof. Then, the normal/compression switched image data Data_SEL[23:0] are produced by the serial/parallel conversion of a ratio of 1:2 from the compressed image data Comp_Data[11:0]. Producing the normal/compression switched image data Data_SEL[23:0] as thus described eliminates the need for increasing the data transfer rates in the data transfer from the normal/multiplied-speed drive switching circuit 3 to the timing controller 5 and the data transfer from the timing controller 5 to the data driver 7, even when the multiplied-speed driving is performed in response to the assertion of the multiplied-speed switching signal 12.

Figure 8:
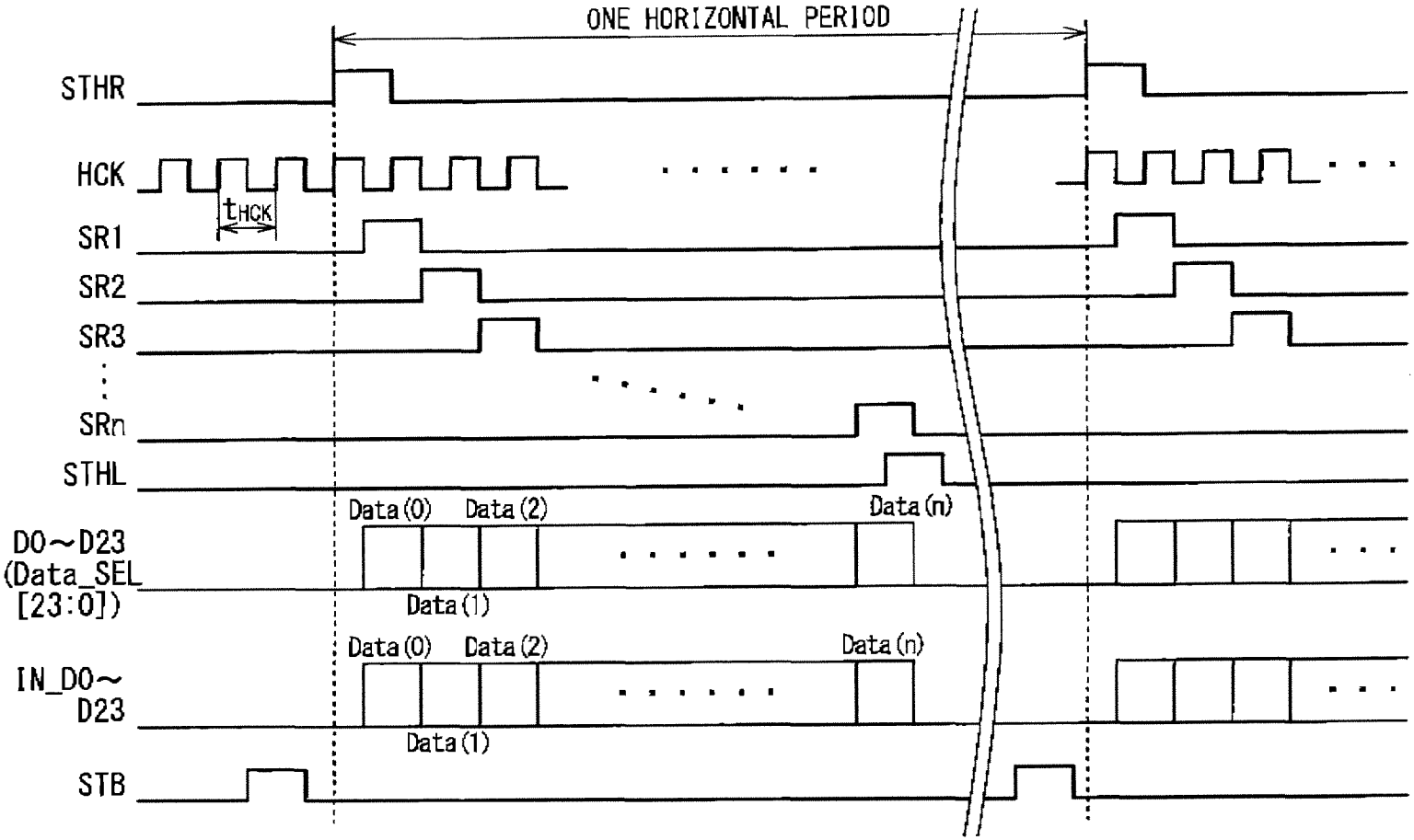
FIG. 8 is a timing chart showing an exemplary operation of the data driver for the normal drive operation in the first embodiment.
Figure 9:
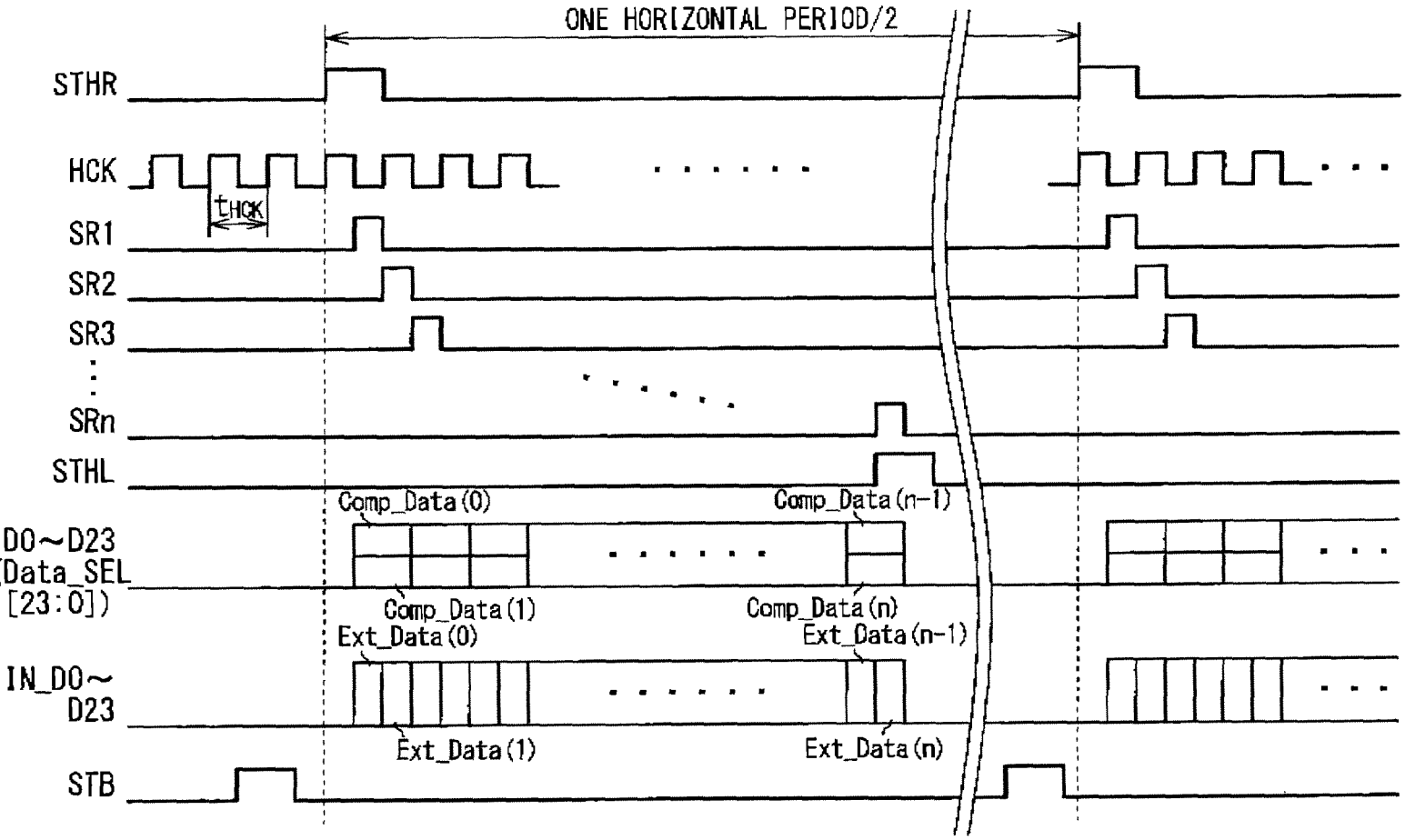
FIG. 9 is a timing chart showing an exemplary operation of the data driver for the multiplied-speed driving in the first embodiment.

On the other hand, FIGS. 8 and 9 are timing charts showing an exemplary operation of the data driver 7 which receives the normal/compression switched image data Data_SEL[23:0] from the normal/multiplied-speed drive switching circuit 3. Herein, FIG. 8 shows an exemplary operation of the data driver 7 when the normal drive operation is performed (without performing the multiplied-speed driving), and FIG. 9 shows an exemplary operation of the data driver 7 when the multiplied-speed driving is performed. In FIGS. 8 and 9, "HCK" represents a clock signal transferred from the timing controller 5 to the data driver 7. The clock signal HCK is one of the data control signals 17 supplied from the timing controller 5 to the data driver 7, and the frequency thereof is the same as that of the clock signal CLK transmitted from the normal/multiplied-speed drive switching circuit 3 to the timing controller 5.

Referring to FIG. 8, when the normal drive operation is performed in response to the negation of the multiplied-speed switching signal 12, a usual operation is performed similarly to that of a commonly-known data driver. That is, the image data Data[23:0] are sequentially inputted and the latch signals SR1 to SRn are sequentially asserted, whereby the image data Data[23:0] respectively associated, with the data lines X1 to Xn are stored in the latch circuits $\mathbf{40}_1$ to $\mathbf{40}_n$ in the data register 35. It should be noted that, in the operation shown in FIG. 8, the time intervals of sequentially asserting the latch signals SR1 to SRn are one clock period of the clock signal HCK. In FIG. 8, the image data Data[23:0] of i-th pixel are denoted by "Data(i)" The stored image data Data(1) to Data(n) are transferred to the D/A converter circuitry 38 through the latch circuitry 36 and the level shift circuitry 37 so that the data lines X1 to Xn are driven in response to the transferred image data Data(1) to Data(n).

When the multiplied-speed switching signal 12 is asserted, on the other hand, the multiplied-speed driving is performed as shown in FIG. 9. In performing the multiplied-speed driving, the normal/compression switched image data Data_SEL [23:0] are the compressed image data Comp_Data[11:0]. More specifically, the higher 12 bits of the normal/compression switched image data Data_SEL[23:0] are the compressed image data Comp_Data[11:0] of one pixel, and the lower 12 bits are the compressed image data Comp_Data[11:0] of another pixel. The compressed image data Comp_Data [11:0] included in the normal/compression switched image data Data_SEL[23:0] are decompressed to thereby reproduce the multiplied-speed drive image data, and the multiplied-speed drive image data are sequentially inputted to the data register circuitry 35. Further, the latch signals SR1 to SRn are sequentially asserted, whereby the multiplied-speed drive image data respectively associated with the data lines X1 to Xn are stored in the latch circuits $\mathbf{40}_1$ to $\mathbf{40}_n$ in the data register 35. In FIG. 9, it should be noted that the multiplied-speed drive image data of the i-th pixel are denoted by "Ext_Data (i)". The multiplied-speed drive image data Ext_Data(1) to Ext_Data(n) stored in the data register circuitry 35 are transferred to the D/A converter circuitry 38 through the latch circuitry 36 and the level shift circuitry 37, so that the data lines X1 to Xn are driven in response to the transferred multiplied-speed drive image data Ext_Data (1) to Ext_Data (n).

As shown in FIG. 9, when the multiplied-speed driving is performed, the data driver 7 is operated at the double frequency of the frequency in the case of the normal drive operation. More specifically, the time intervals of sequentially asserting the latch signals SR1 to SRn in response to the assertion of the multiplied-speed switching signal 12 are adjusted to the half of the clock period of the clock signal HCK. The shift register circuitry 31 produces the latch signals SR1 to SRn in synchronization with the falling edges of the clock signal HCK in performing the normal drive operation as shown in FIG. 8; on the other hand, in performing the multiplied-speed driving, the shift register circuitry 31 produces the latch signals SR1 to SRn in synchronization with both of the falling edges and rising edges of the clock signal HCK. It should be noted here that the shift register circuitry 31 is configured to switch the time intervals of sequentially asserting the latch signals SR1 to SRn in response to the assertion of the multiplied-speed switching signal 12 as described above. Moreover, the periods of asserting the shift pulse signal STHR and the latch signal STB are reduced down to one half of those in performing the normal drive operation. Thus, the latch circuitry 36, the level shift circuitry 37, the D/A converter circuitry 38 and the buffer circuitry 39 are operated at a doubled frequency so that the multiplied-speed driving is performed.

It should be noted that the operating frequency is doubled only inside the data driver 7 in this embodiment, when the multiplied-speed driving is performed. The frequency of the data transfer of the normal/compression switched image data Data_SEL[23:0] is unchanged between the multiplied-speed driving and the normal drive operation. In this embodiment, it is not necessary to increase the frequency of the data transfer from the timing controller 5 to the data driver 7, since the multiplied-speed drive image data are transferred as the normal/compression switched image data Data_SEL[23:0] from the timing controller 5 to the data driver 7 after subjected to compression. This is effective for suppressing the EMI from the data transfer line and reducing the power consumption.

As described above, the liquid crystal display device 1 of this embodiment effectively reduces the amount of the data transfer from the normal/multiplied-speed drive switching circuit 3 to the timing controller 5 and the amount of data transfer from the timing controller 5 to the data driver 7, since the multiplied-speed drive image data are transferred inside the liquid crystal display device 1 after subjected to compression. The reduction of the amount of the data transfer eliminates the need of high-speed data transfer within the liquid crystal display device 1, and also reduces the EMI from the data transfer line as well as the power consumption.

It should be noted that, although the latch signals SR1 to SRn are sequentially asserted in synchronization with the falling edges of the clock signal HCK when the normal drive operation is performed with the multiplied-speed switching signal 12 negated in this embodiment, the latch signals SR1 to SRn may be sequentially asserted in synchronization with the rising edges of the clock signal HCK instead. Revisions in the circuit configuration required by such modification in the operation would be obvious for those skilled in the art.

Second Embodiment

In a second embodiment, a compressing process is performed as to produce one unit of compressed image data from the multiplied-speed drive image data DD[23:0] associated with a plurality of pixels, and the produced one unit of compressed image data are transferred over a plurality of clock periods; it should be noted that, in the first embodiment, the compressed image data Comp_Data[11:0] corresponding to one pixel are produced from the multiplied-speed drive image data DD[23:0] associated with one pixel. Performing the compression process on the image data in units of a plurality of pixels allows producing the compressed image data on the basis of the correlation among the plurality of pixels; therefore, producing one unit of compressed image data from the multiplied-speed drive image data DD of the plurality of pixels is preferable as the compression process in terms of suppression of deterioration of the image.

It should be noted that, when one unit of compressed image data are transferred over the plurality of clock periods, the transfer of the multiplied-speed drive image data to the latch circuits $\mathbf{40}_{4i-3}$ to $\mathbf{40}_{4i}$ should be started after the one unit of compressed image data are fully received and decompressed. In order to meet this requirement, the transfer of the multiplied-speed drive image data to the data register circuitry 35 is started after the reception of the compressed image data by the data driver 7. In the normal drive operation, on the other hand, it is not necessary to delay the timing of starting the transfer of the image data 11 to the data register circuitry 35 than the timing of receiving the image data 11 by the data driver 7.

Therefore, the start timing of the data transfer to the data register circuitry 35 is delayed in this embodiment, when the multiplied-speed drive processing is performed. In the following, a detailed description is given of the configuration and operation of the liquid crystal display device 1 of the second embodiment.

Figure 10:
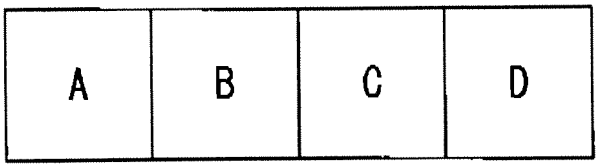
FIG. 10 is a diagram showing a compressing process of multiplied-speed drive image data in a second embodiment.

In the second embodiment, one unit of compressed image data are produced from the multiplied-speed drive image data DD[23:0] of four pixels arrayed in the same horizontal line as shown in FIG. 10. Further, one unit of compressed image data are transferred to the data driver 7 over two clock periods.

Figure 11:
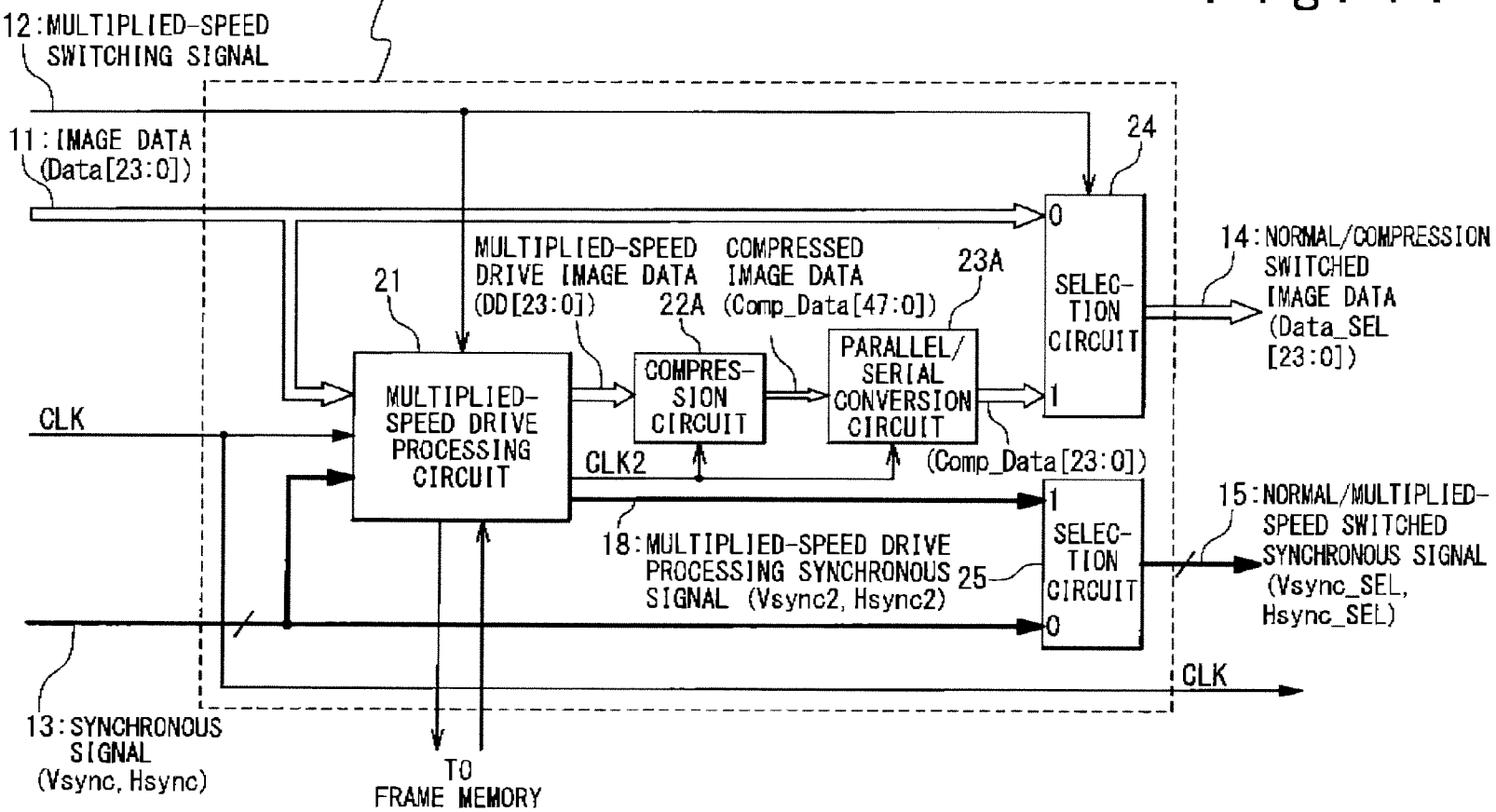
FIG. 11 is a block diagram showing an exemplary configuration of a normal/multiplied-speed drive switching circuit in the second embodiment.

FIG. 11 is a block diagram showing an exemplary configuration of the normal/multiplied-speed drive switching circuit 3 for attaining such operation. In the second embodiment, the normal/multiplied-speed drive switching circuit 3 includes a multiplied-speed drive processing circuit 21, a compression circuit 22A, a parallel/serial conversion circuit 23A and selection circuits 24 and 25. The operations of the multiplied-speed drive processing circuit 21 and the selection circuits 24 and 25 are the same as those in the first embodiment.

In the second embodiment, the compression circuit 22A produces 48-bit compressed image data [47:0] from the multiplied-speed drive image data DD[23:0] of four pixels arrayed in the same horizontal line. It should be noted that, since the multiplied-speed drive image data DD[23:0] of four pixels include 96 bits, the compression circuit 22A consequently performs a compressing process in which the data amount is reduced down to the half. The parallel/serial conversion circuit 23A performs a parallel/serial conversion of a ratio of 2:1 on the 48-bit compressed image data [47:0] to thereby produce 24-bit compressed image data [23:0]. When the multiplied-speed switching signal 12 is asserted, the compressed image data [23:0] produced by the parallel/serial conversion circuit 23A are transferred to the data driver 7. As a result, the 48-bit compressed image data [47:0] are transferred to the data driver 7 over two clock periods.

Figure 12:
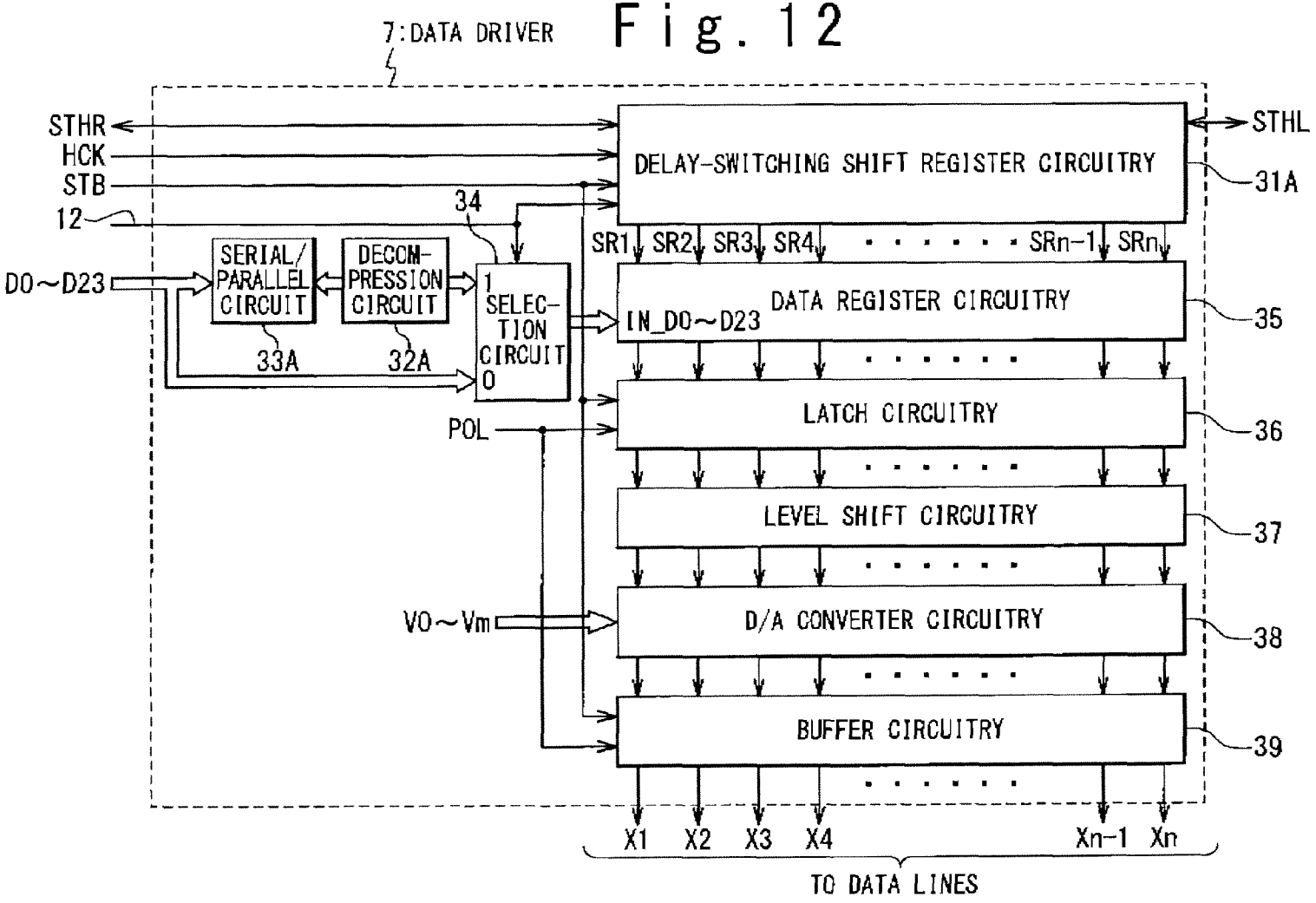
FIG. 12 is a block diagram showing an exemplary of a data driver in the second embodiment.

FIG. 12 is a block diagram showing an exemplary configuration of the data driver 7 in the second embodiment. The configuration of the data driver 7 in the second embodiment is almost similar to that of the first embodiment; the difference is that a delay-switching shift register circuitry 31A, a decompression circuit 32A and a serial/parallel conversion circuit 33A are used instead of the shift register circuitry 31, the decompression circuit 32 and the parallel/serial conversion circuit 33. The serial/parallel conversion circuit 33A performs a serial/parallel conversion of a ratio of 1:2 on the normal/compression switched image data Data_SEL[23:0]. Herein, when the multiplied-speed driving is performed, the compressed image Data[23:0] produced by the parallel/serial conversion of a ratio of 2:1 on the 48-bit compressed image data [47:0] are transmitted as the normal/compression switched image data Data_SEL[23:0]. Consequently, the serial/parallel conversion circuit 33A has a role of reproducing the 48-bit compressed image data [47:0]. The decompression circuit 32A decompresses the 48-bit compressed image data [47:0] to reproduce the multiplied-speed drive image Data[23:0] and transmits the multiplied-speed drive image Data[23:0] to the selection circuit 34. The delay-switching shift register circuitry 31A produces the latch signals SR1 to SRn to be supplied to the data register circuitry 35. The delay-switching shift register circuitry 31A switches the timing of starting the sequential assertion of the latch signals SR1 to SRn in response to the multiplied-speed switching signal 12 (i.e., in accordance with execution/inexecution of the multiplied-speed driving). That is, the delay-switching shift register circuitry 31A operates as a delay controller for controlling the timing of starting reception of the data by the data register circuitry 35.

Figure 13:
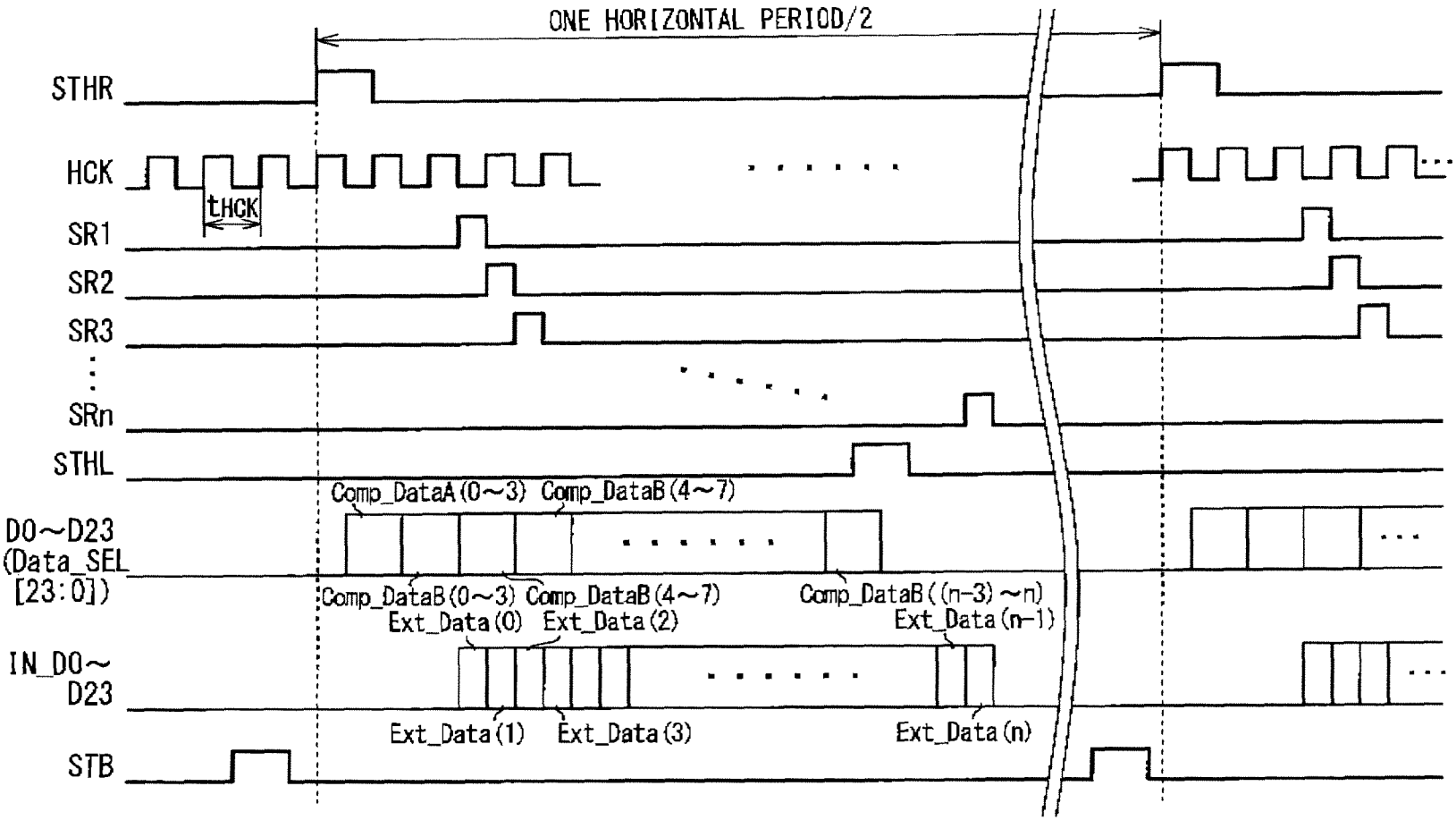
FIG. 13 is a timing chart showing an exemplary operation of the data driver for the multiplied-speed driving in the second embodiment.

FIG. 13 is a timing chart showing an exemplary operation of the data driver 7 when the multiplied-speed driving is performed in the second embodiment; the operation of the data driver 7 is the same as that of the first embodiment when the normal drive operation is performed (see FIG. 8). It should be noted here that, in performing the normal drive operation, the assertion of the latch signals SR1 to SRn is started when the clock signal HCK is first pulled down after the start pulse signal STHR is asserted and that the time intervals of sequentially asserting the latch signals SR1 to SRn are one clock period of the clock signal HCK.

When the multiplied-speed driving is performed, on the other hand, the multiplied-speed drive image data produced by decompressing the compressed image data are started to be transferred to the data register circuitry 35 after two clock periods from the time of starting the reception of the compressed image data, as shown in FIG. 13. In FIG. 13, "Comp_DataA(k−(k+3))" represents the former half 24 bits of the 48-bit compressed image data [47:0] corresponding to the k-th to (k+3)-th pixels, and "Comp_DataB(k−(k+3))" represents the latter half 24 bits of the 48-bit compressed image data [47:0]. "Ext_Data(i)" represents the multiplied-speed drive image data associated with the i-th pixel obtained by decompressing the compressed image data.

More specifically, after the compressed image data Comp_DataA(0-3) and Comp_DataB(0-3) are received over the two clock periods, the multiplied-speed drive image data Ext_Data(0) to (3) obtained by decompressing the compressed image data Comp_DataA (0-3) and Comp_DataB (0-3) are sequentially transferred to the data register circuitry 35. At this time, the assertion of the latch signals SR1 to SR4 is started when the clock signal HCK is pulled down after two clock periods from the time of pulling down of the first clock signal HCK after the assertion of the start pulse signal STHR. The next compressed image data Comp_DataA(4-7) and Comp_DataB(4-7) are received during the transfer of the multiplied-speed drive image data Ext_Data(0) to Ext_Data (3), and by a similar operation thereafter, the reproduction of the multiplied-speed drive image data corresponding to one horizontal line and the transfer to the data register circuitry 35 thereof are completed. The multiplied-speed drive image data transferred to the data register circuitry 35 are transferred to the D/A converter circuitry 38 through the latch circuitry 36 and the level shift circuitry 37 so that the data lines X1 to Xn are driven in response to the multiplied-speed drive image data.

The liquid crystal display device 1 of the second embodiment also eliminates the need for increasing the frequency of the data transfer from the timing controller 5 to the data driver 7, since the multiplied-speed drive image data are transferred to the data driver 7 as the normal/compression switched image data Data_SEL[22:0] after subjected to compression. This effectively suppresses the EMI from the data transfer line and reduces the power consumption. In addition, in the second embodiment, the compressed data can be produced based on the correlation among pixels by compressing the image data in units of a plurality of pixels, and therefore the compression process can be achieved with the deterioration of the image suppressed.

Although various embodiments of the present invention are specifically described above, it would apparent that the present invention is not limited to the above embodiments, but may be modified and changed without departing from the scope of the invention.

For example, in the embodiments described above, although the operation is explained for the case of the double-speed driving, that is, for the case when multiplied-speed drive image data associated with two frame images are produced from image data associated with the corresponding one frame image externally supplied to the liquid crystal display device 1, the present invention may be adapted to N-fold multiplied-speed driving (N being an integer of 2 or more), that is, in a case when the multiplied-speed drive image data associated with N flame images are produced for the image data of one actual frame image. It should be noted that the phrase "multiplied-speed driving" means to include a case of N being 3 or more, in the description of the present application. In this case, a compression process is performed to produce the compressed image data having a data amount reduced down to one N-th in the compression circuit 22 of the normal/multiplied-speed drive switching circuit 3, and the compressed image data are transferred from the normal/multiplied-speed drive switching circuit 3 to the timing controller 5, and further transferred from the timing controller 5 to the data driver 7.

Moreover, although the normal/multiplied-speed drive switching circuit 3, the frame memory 4, the timing controller 5 and the data driver 7 are implemented as separate integrated circuits in the embodiments described above, the normal/multiplied-speed drive switching circuit 3 and the timing controller 5 may be monolithically integrated within a single integrated circuit. In this case, the normal/multiplied-speed drive switching circuit 3 and the timing controller 5 operate as a single controller for controlling the liquid crystal display device 1. Even in this case, the data transfer amount from the timing controller 5, which performs the multiplied-speed drive processing, to the data driver 7 is reduced, and this eliminates the need for high-speed data transfer inside the liquid crystal display device 1, reducing the EMI from the data transfer line as well as power consumption.

Furthermore, although the above-described embodiments are directed the liquid crystal display device 1 in, it would be apparent for those skilled in the art that the present invention is applicable to any hold-type display devices.

What is claimed is:

1. A display device, comprising:

a display panel;

a driver driving said display panel; and a controller adapted to perform multiplied-speed drive processing on original image data externally supplied thereto, wherein said driver is adapted to drive said display panel by multiplied-speed driving, wherein, when said driver performs said multiplied-speed driving, said controller generates multiplied-speed drive image data by performing the multiplied-speed drive processing on said original image data, generates compressed image data by compressing the multiplied-speed drive image data, wherein a frequency of multiplied-speed driving is set as a normal frequency times an integer N to produce said multiplied-speed drive image data associated with N frame images, wherein said multiplied-speed drive image data is compressed by a factor of 1/N, wherein said compressed image data is received as an input to a serial/parallel conversion circuit which performs a serial/parallel conversion using a ratio of 1:N on said compressed image data, wherein said compressed image data is transferred to said driver, wherein, when said driver does not perform said multiplied-speed driving, said controller transfers said original image data to said driver;

wherein, when said driver performs said multiplied-speed driving, said driver decompresses said compressed image data by a factor of N to generate decompressed image data, wherein said decompressed image data is received as an input to a parallel/serial conversion circuit which performs a parallel/serial conversion using a ratio of N:1 on said decompressed data, to thereby reproduce said multiplied-speed drive image data, and drives said display panel in response to said reproduced multiplied-speed drive image data, and wherein when said driver does not perform said multiplied-speed driving, said driver drives said display panel in response to said original image data received from said controller.

2. The display device according to claim 1, wherein a data transfer rate of said compressed image data from said controller to said driver is same as that of said original image data from said controller to said driver.

3. The display device according to claim 2, wherein said driver receives said compressed image data and said original image data from said controller in synchronization with a clock signal received from said controller, and wherein a frequency of said clock signal is unchanged between a case when said compressed image data are transferred from said controller to said driver and a case when said original image data are transferred from said controller to said driver.

4. The display device according to claim 3, wherein said controller supplies a multiplied-speed switching signal which indicates said driver to perform said multiplied-speed driving, wherein said driver further includes:

a selector responsive to said multiplied-speed switching signal for selecting said original image data or said multiplied-speed drive image data as selected image data;

a data register circuitry comprising a plurality of latch circuits sequentially latching said selected image data;

a latch controller feeding a plurality of latch signals to said plurality of latch circuits, respectively; and a drive circuitry driving said display panel in response to said selected image data received from said data register circuitry, wherein said plurality of latch circuits each latch is associated with one of said selected image data in response to assertion of associated one of said latch signals fed thereto, wherein said latch controller is responsive to said multiplied-speed switching signal for selectively performing one of a first operation of sequentially asserting said plurality of latch signals in response to rising or falling edges of said clock signal and a second operation of sequentially asserting said plurality of latch signals in response to the rising and falling edges of said clock signal.

5. The display device according to claim 3, wherein said controller supplies a multiplied-speed switching signal which indicates said driver to perform said multiplied-speed driving, wherein, when said driver performs said multiplied-speed driving, said controller generates one unit of said compressed image data from said multiplied-speed drive image data, and transfer the one unit of said compressed image data to said driver over a plurality of clock cycles of said clock signal, wherein said driver further includes:

a selector responsive to said multiplied-speed switching signal for selecting said original image data or said multiplied-speed drive image data as selected image data;

a data register circuitry comprising a plurality of latch circuits sequentially latching said selected image data;

a drive circuitry driving said display panel in response to said selected image data received from said data register circuitry; and a delay controller controlling timings of reception of said original image data or said multiplied-speed drive image data by said data register circuitry, wherein said delay controller is responsive to said multiplied-speed switching signal for controlling a timing at which said data register circuitry starts to receive said original image data or said multiplied-speed drive image data.

6. The display device according to claim 1, wherein said controller includes:

a normal/multiplied-speed drive switching circuit; and a timing controller, wherein said timing controller transfers said compressed image data or said original image data received from said normal/multiplied-speed drive switching circuit, to said driver.

7. The display device according to claim 6, wherein a data transfer rate of said compressed image data from said normal/multiplied-speed drive switching circuit to said timing controller is same as that of said original image data from said normal/multiplied-speed drive switching circuit to said timing controller.

8. The display device, according to claim 1, wherein a frequency of multiplied-speed driving is set as a normal frequency times an integer 2 to produce said multiplied-speed drive image data associated with 2 frame images, wherein said multiplied-speed drive image data is compressed by a factor of ½, such that bits of said compressed image data corresponding to a 2k-th pixel are used as a higher n/2 bits of said compressed image data and bits of said compressed image data corresponding to a 2k+1-th pixel are used as a lower n/2 bits of said compressed image data, wherein said compressed image data is received as an input to said serial/parallel conversion circuit which performs said serial/parallel conversion using a ratio of 1:2 for said compressed image data, and wherein said compressed image data is transferred to said driver.

9. A driver receiving a multiplied-speed switching signal which indicates performing multiplied-speed driving and driving a display panel in response to original image data or compressed image data generated by performing compression processing on multiplied-speed drive image data, said driver comprising:

a decompression circuit reproducing said multiplied-speed drive image data from said compressed image data by decompressing said compressed image data by a factor of N to generate decompressed image data;

a parallel/serial conversion circuit, receiving as an input said decompressed image data, which performs a parallel/serial conversion using a ratio of N:1 on said decompressed data, to thereby reproduce said multiplied-speed drive image data;

a selector responsive to said multiplied-speed switching signal for selecting said original image data or said multiplied-speed drive image data as selected image data;

a data register circuitry comprising a plurality of latch circuits sequentially latching said selected image data;

a latch controller feeding a plurality of latch signals to said plurality of latch circuits, respectively; and a drive circuitry driving said display panel in response to said selected image data received from said data register circuitry, wherein said plurality of latch circuits each latch associated one of said selected image data in response to assertion of associated one of said latch signals fed thereto, wherein said latch controller is responsive to said multiplied-speed switching signal for selectively performing one of a first operation of sequentially asserting said plurality of latch signals in response to rising or falling edges of said clock signal and a second operation of sequentially asserting said plurality of latch signals in response to the rising and falling edges of said clock signal.

10. An operation method of a display device including a display panel, a driver and a controller, said method comprising:

externally receiving original image data by said controller;

generating multiplied-speed drive image data by performing multiplied-speed drive processing on said original image data, wherein a frequency of multiplied-speed driving is set as a normal frequency times an integer N to produce said multiplied-speed drive image data associated with N frame images, in said controller, when said driver performs a first drive operation in which said driver drives said display panel with said multiplied-speed driving;

generating compressed image data, wherein said multiplied-speed drive image data is compressed by a factor of 1/N, by performing compression processing on said multiplied-speed drive image data in said controller when said first drive operation is performed;

transferring said compressed image data from said controller to said driver when said first drive operation is performed, wherein an intermediate step comprises receiving said compressed image data as an input to a serial/parallel conversion circuit which performs a serial/parallel conversion using a ratio of 1:N on said compressed image data;

reproducing said multiplied-speed drive image data by decompressing said compressed image data, wherein said compressed image data is decompressed by a factor of N to generate decompressed image data and said decompressed image data is received as an input to a parallel/serial conversion circuit which performs a parallel/serial conversion using a ratio of N:1 on said decompressed data, in said driver when said first drive operation is performed;

driving said display panel in response to said reproduced multiplied-speed drive image data by said driver when said first drive operation is performed;

transferring said original image data from said controller to said driver when said driver performs a second drive operation in which said driver drives said display panel without using said multiplied-speed driving; and driving said display panel in response to said original image data by said driver when said second drive operation is performed.

11. The operation method according to claim 10, further comprising:

supplying a multiplied-speed switching signal which selects one of said first and second drive operations, wherein said multiplied-speed switching signal is set to indicate performing said first drive operation when said original image data are video image data, and wherein said multiplied-speed switching signal is set to indicate performing said second drive operation when said original image data are still image data.

12. A display device, comprising:

a display panel;

a driver driving said display panel; and a controller adapted to perform multiplied-speed drive processing on original image data externally supplied thereto, wherein said driver is adapted to drive said display panel by multiplied-speed driving, wherein, when said driver performs said multiplied-speed driving, said controller generates multiplied-speed drive image data by performing the multiplied-speed drive processing on said original image data, generates compressed image data by compressing the multiplied-speed drive image data, wherein said compressed image data is received as an input to a parallel/serial conversion circuit which performs a parallel/serial conversion on said compressed image data, wherein said compressed image data is transferred to said driver, wherein, when said driver does not perform said multiplied-speed driving, said controller transfers said original image data to said driver;

wherein, when said driver performs said multiplied-speed driving, said driver decompresses said compressed image data, wherein said decompressed image data is received as an input to a serial/parallel conversion circuit which performs a serial/parallel conversion on said decompressed data, to thereby reproduce said multiplied-speed drive image data, and drives said display panel in response to said reproduced multiplied-speed drive image data, and wherein when said driver does not perform said multiplied-speed driving, said driver drives said display panel in response to said original image data received from said controller.

* * * * *